US010993871B2

(12) United States Patent
Watabe et al.

(10) Patent No.: US 10,993,871 B2
(45) Date of Patent: May 4, 2021

(54) WALKING SUPPORT ROBOT AND WALKING SUPPORT METHOD

(71) Applicant: Panasonic Corporation, Osaka (JP)

(72) Inventors: Mayu Watabe, Tokyo (JP); Kazunori Yamada, Aichi (JP); Yoji Yamada, Aichi (JP)

(73) Assignee: PANASONIC CORPORATION, Osaka (JP)

( * ) Notice: Subject to any disclaimer, the term of this patent is extended or adjusted under 35 U.S.C. 154(b) by 388 days.

(21) Appl. No.: 15/920,503

(22) Filed: Mar. 14, 2018

(65) Prior Publication Data

US 2018/0271739 A1 Sep. 27, 2018

(30) Foreign Application Priority Data

Mar. 21, 2017 (JP) ..... JP2017-054376

(51) Int. Cl.
*A61H 3/04* (2006.01)

(52) U.S. Cl.
CPC ..... *A61H 3/04* (2013.01); *A61H 2003/043* (2013.01); *A61H 2201/5007* (2013.01); *A61H 2201/5061* (2013.01); *A61H 2201/5064* (2013.01); *A61H 2201/5084* (2013.01); *Y10S 901/01* (2013.01); *Y10S 901/46* (2013.01)

(58) Field of Classification Search
CPC ..... A61H 3/04; A61H 2201/5084; A61H 2003/043; A61H 2201/5007; A61H 2201/5061; Y10S 901/46; Y10S 901/01
See application file for complete search history.

(56) References Cited

U.S. PATENT DOCUMENTS 8,014,923 B2 * 9/2011 Ishii ..... B62D 51/005 180/218
10,213,357 B2 * 2/2019 Harding ..... B62D 57/032
2010/0035728 A1 * 2/2010 Shinomiya ..... A61B 5/1038 482/8
2010/0100013 A1 4/2010 Hu et al.
2014/0358344 A1 * 12/2014 Katayama ..... A61H 3/04 701/22
2015/0359699 A1 * 12/2015 Chang ..... A61H 3/04 701/22

(Continued)

FOREIGN PATENT DOCUMENTS

EP 3000456 A1 3/2016
JP 2000-102576 4/2000

(Continued)

*Primary Examiner* — Bickey Dhakal
(74) *Attorney, Agent, or Firm* — Greenblum & Bernstein. P.L.C.

(57) ABSTRACT

A walking support robot of the present disclosure is a walking support robot that moves in accordance with a handle force while supporting walking of a user. The walking support robot includes a body, a handle that is on the body and is held by the user, a sensor that senses a force applied to the handle, and a moving device that includes a rotating member and moves the walking support robot by controlling rotation of the rotating member in accordance with the force sensed by the sensor. The walking support robot estimates a leg position of the user on a basis of a change of the force sensed by the sensor, and sets a load to be applied to the user on a basis of the leg position.

16 Claims, 30 Drawing Sheets

(56) References Cited

U.S. PATENT DOCUMENTS

| | | | | |
|---|---|---|---|---|
| 2017/0001656 | A1* | 1/2017 | Katayama | G08C 17/02 |
| 2019/0262216 | A1* | 8/2019 | Kanaya | A61H 3/04 |
| 2020/0085668 | A1* | 3/2020 | Yu | A61H 3/04 |

FOREIGN PATENT DOCUMENTS

| | | | |
|---|---|---|---|
| JP | 2007-090019 | | 4/2007 |
| JP | 2007-202924 | A | 8/2007 |
| JP | 2013-103079 | | 5/2013 |
| JP | 2014-230681 | | 12/2014 |
| JP | 2016-005498 | A | 1/2016 |
| JP | 2016-093221 | | 5/2016 |
| JP | 2016-168191 | A | 9/2016 |
| WO | 2014/188726 | A1 | 11/2014 |

* cited by examiner

FIG. 6A

| USER NAME | WALKING SPEED | WALKING RATE | BODY TILT | BODY SHAKE | | STRIDE | MUSCULAR STRENGTH OF LEG PORTION | | |
|---|---|---|---|---|---|---|---|---|---|
| | | | | | | | TIBIALIS ANTERIOR MUSCLE | SOLEUS MUSCLE | ... |
| A | 56 cm/s | 106 STEPS /min | Fy:-10N Mz:1.0Nm | Fy:2Hz My:2Hz | LEFT LEG | 50 cm | 5 | 4 | ... |
| | | | | | RIGHT LEG | 20 cm | 2 | 5 | ... |

FIG. 6B

| USER NAME | MOVING DIRECTION | INPUT WAVEFORM | WALKING SPEED | WALKING RATE | AVERAGE WEIGHT IN MOVING DIRECTION | AVERAGE WEIGHT IN DIRECTION IN WHICH CENTER OF GRAVITY IS DEVIATED | FLUCTUATION FREQUENCY IN MOVING DIRECTION | FLUCTUATION FREQUENCY IN LEFT-RIGHT DIRECTION | | STRIDE | MUSCULAR STRENGTH OF LEG PORTION | | |
|---|---|---|---|---|---|---|---|---|---|---|---|---|---|
| | | | | | | | | | | | TIBIALIS ANTERIOR MUSCLE | SOLEUS MUSCLE | ... |
| A | MOVING STRAIGHT IN FORWARD DIRECTION | No.1 No.3 | 56 cm/s | 106 STEPS /min | Fy:-10N | Mz:1.0Nm | Fy:2Hz | My:2Hz | LEFT LEG | 50 cm | 5 | 4 | ... |
| | | | | | | | | | RIGHT LEG | 20 cm | 2 | 5 | ... |
| | ... | | ... | ... | ... | ... | ... | ... | ... | ... | ... | ... | ... |

FIG. 11

| | | | MUSCULAR STRENGTH | LEG POSITION | | | |
|---|---|---|---|---|---|---|---|
| | | | | INITIAL CONTACT | LOADING RESPONSE | MID STANCE | ... |
| BODY INFORMATION | LEFT LEG | TIBIALIS ANTERIOR MUSCLE | 5 | Fy DIRECTION: +10N | Fy DIRECTION: +10N | Fy DIRECTION: +10N | ... |
| | | ... | ... | ... | ... | ... | ... |
| | RIGHT LEG | TIBIALIS ANTERIOR MUSCLE | 3 | Fy DIRECTION: -10N | Fy DIRECTION: -10N | Fy DIRECTION: -15N | ... |
| | | ... | ... | ... | ... | ... | ... |

FIG. 22A

| | | INITIAL CONTACT | LOADING RESPONSE | MID STANCE | TERMINAL STANCE | PRE SWING | INITIAL SWING | MID SWING | TERMINAL SWING |
|---|---|---|---|---|---|---|---|---|---|
| CROTCH PORTION | GLUTEUS MAXIMUS MUSCLE | ○ | ○ | | | | | | ○ |
| | ADDUCTOR MAGNUS MUSCLE | ○ | ○ | | | | | | ○ |
| | BICEPS FEMORIS MUSCLE | ○ | ○ | | | | | ○ | ○ |
| | ... | ... | ... | ... | ... | ... | ... | ... | ... |
| KNEE PORTION | VASTUS INTERMEDIUS MUSCLE | ○ | ○ | | | | | | ○ |
| | VASTUS MEDIALIS MUSCLE | ○ | ○ | | | | | | ○ |
| | VASTUS LATERALIS MUSCLE | ○ | ○ | | | | | | ○ |
| | ... | ... | ... | ... | ... | ... | ... | ... | ... |
| LEG PORTION | SOLEUS MUSCLE | ○ | ○ | ○ | ○ | | | | |
| | EXTENSOR DIGITORUM LONGUS MUSCLE | ○ | ○ | | | ○ | ○ | ○ | ○ |
| | EXTENSOR HALLUCIS LONGUS MUSCLE | ○ | ○ | | | ○ | ○ | ○ | ○ |
| | ... | ... | ... | ... | ... | ... | ... | ... | ... |

FIG. 22B

| | | HEEL STRIKE | HEEL OFF | TOE OFF | ACCELERATION | DECELERATION |
|---|---|---|---|---|---|---|
| CROTCH PORTION | GLUTEUS MAXIMUS MUSCLE | ○ | | | | ○ |
| | ADDUCTOR MAGNUS MUSCLE | ○ | | | | ○ |
| | BICEPS FEMORIS MUSCLE | ○ | | | ○ | ○ |
| | ... | ... | ... | ... | ... | ... |
| KNEE PORTION | VASTUS INTERMEDIUS MUSCLE | ○ | | | | ○ |
| | VASTUS MEDIALIS MUSCLE | ○ | | | | ○ |
| | VASTUS LATERALIS MUSCLE | ○ | | | | ○ |
| | ... | ... | ... | ... | ... | ... |
| LEG PORTION | SOLEUS MUSCLE | ○ | ○ | | | |
| | EXTENSOR DIGITORUM LONGUS MUSCLE | ○ | | ○ | ○ | ○ |
| | EXTENSOR HALLUCIS LONGUS MUSCLE | ○ | | ○ | ○ | ○ |
| | ... | ... | ... | ... | ... | ... |

FIG. 26

| | | | MUSCULAR STRENGTH | LEG POSITION | | | |
|---|---|---|---|---|---|---|---|
| | | | | INITIAL CONTACT | LOADING RESPONSE | ACCELERATION | ... |
| BODY INFORMATION | LEFT LEG | TIBIALIS ANTERIOR MUSCLE | 5 | RADIUS OF TURN: +5 cm | RADIUS OF TURN: +5 cm | RADIUS OF TURN: +5 cm | ... |
| | | ... | ... | ... | ... | ... | ... |
| | RIGHT LEG | TIBIALIS ANTERIOR MUSCLE | 3 | RADIUS OF TURN: -5 cm | RADIUS OF TURN: -5 cm | RADIUS OF TURN: -10 cm | ... |
| | | ... | ... | ... | ... | ... | ... |

FIG. 30

| | | | MUSCULAR STRENGTH | LEG POSITION | | | |
|---|---|---|---|---|---|---|---|
| | | | | INITIAL CONTACT | LOADING RESPONSE | ACCELERATION | ... |
| BODY INFORMATION | LEFT LEG | TIBIALIS ANTERIOR MUSCLE | 5 | GUIDE DISTANCE: -3 cm | GUIDE DISTANCE: -3 cm | GUIDE DISTANCE: -3 cm | ... |
| | | ... | ... | ... | ... | ... | ... |
| | RIGHT LEG | TIBIALIS ANTERIOR MUSCLE | 3 | GUIDE DISTANCE: +3 cm | GUIDE DISTANCE: +3 cm | GUIDE DISTANCE: +5 cm | ... |
| | | ... | ... | ... | ... | ... | ... |

WALKING SUPPORT ROBOT AND WALKING SUPPORT METHOD

BACKGROUND

1. Technical Field

The present disclosure relates to a walking support robot and a walking support method for supporting user's walking.

2. Description of the Related Art

A walking support machine that controls movement in accordance with force applied to a handle has been developed as an apparatus for supporting walking of a user such as an elderly person (see, for example, Japanese Unexamined Patent Application Publication No. 2007-90019).

The walking support machine disclosed in Japanese Unexamined Patent Application Publication No. 2007-90019 senses force applied to the handle and controls driving force in a forward or backward direction of the walking support machine in accordance with a value of the sensed force.

SUMMARY

In recent year, there are demands for a walking support robot and a walking support method that improve physical performance while supporting user's walking.

One non-limiting and exemplary embodiment provides a walking support robot and a walking support method that can improve physical performance while supporting user's walking.

In one general aspect, the techniques disclosed here feature a walking support robot including: a body; a handle that is on the body and configured to be held by a user; a sensor that senses a force applied to the handle; a moving device that includes a rotating member and moves the walking support robot by controlling rotation of the rotating member in accordance with the force sensed by the sensor; and a processor that, in operation, performs operations including: estimating a leg position of the user on a basis of a change of the force sensed by the sensor; and setting a load to be applied to the user on a basis of the leg position.

As described above, according to a walking support robot and a walking support method according to the present disclosure, it is possible to improve physical performance while supporting user's walking.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 6A illustrates an example of body information stored in a body information database;

FIG. 6B illustrates another example of body information stored in the body information database;

FIG. 11 illustrates an example of load setting;

FIG. 22A illustrates an example of a table illustrating a relationship between a leg position and a muscle used for walking;

FIG. 22B illustrates an example of a table illustrating a relationship between a leg position and a muscle used for walking;

FIG. 26 illustrates an example of turning load information;

FIG. 30 illustrates an example of load information based on guide information.

DETAILED DESCRIPTION

Figure 1:
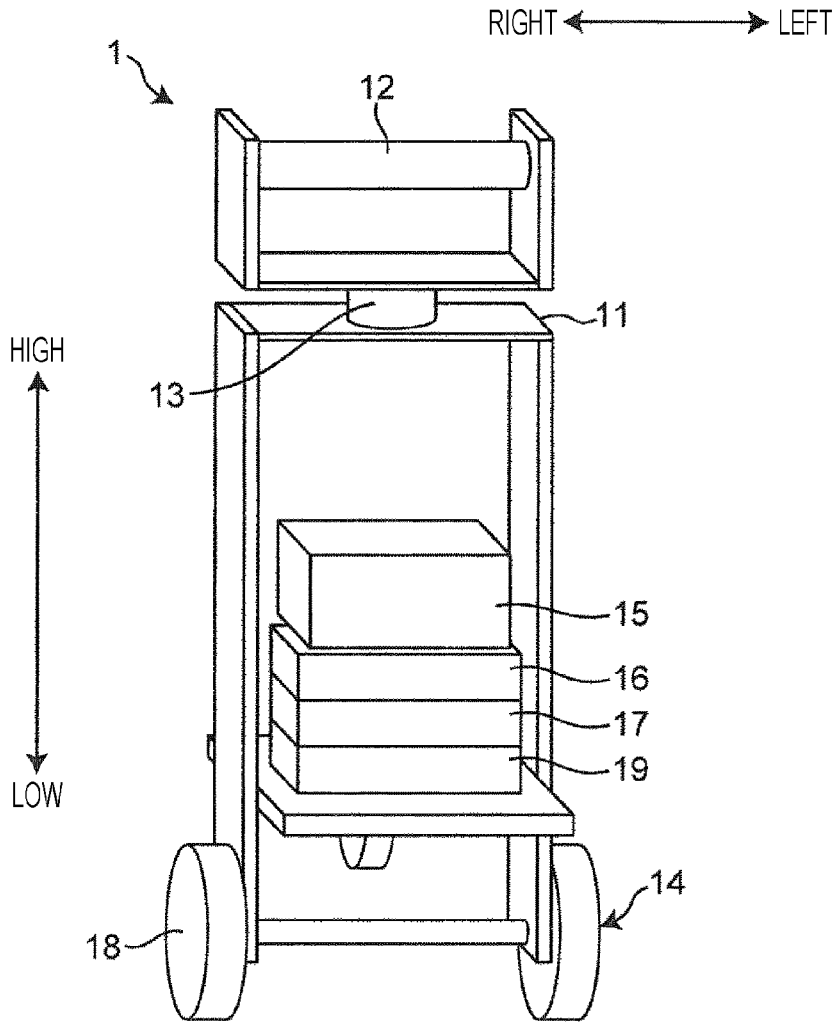
FIG. 1 illustrates external appearance of a walking support robot according to Embodiment 1 of the present disclosure.

Underlying Knowledge Forming Basis of the Present Disclosure

In recent years, the birth rate is decreasing and the population is aging in developed countries. Therefore, there is greater need to watch over elderly people and provide livelihood support to elderly people. Especially for elderly people, it tends to become difficult to keep quality of life (QOL) at home because of a decrease in physical performance resulting from aging.

In view of such circumstances, there are demands for a walking support robot that can improve user's physical performance while supporting walking of a user such as an elderly person.

As described in BACKGROUND, a walking support machine that supports user's walking by controlling movement in a forward or backward direction in accordance with a change of force applied to a handle has been developed as an apparatus for supporting user's walking (see, for example, Japanese Unexamined Patent Application Publication No. 2007-90019).

However, Japanese Unexamined Patent Application Publication No. 2007-90019 fails to disclose improving user's physical performance.

Furthermore, for example, a walking training apparatus that moves a user's leg, for example, by using an arm in accordance with a walking pattern that is input in advance has been developed as an apparatus that improves a user's walking function (see, for example, Japanese Unexamined Patent Application Publication No. 2006-6384). This walking training apparatus trains user's walking by moving a user's body trunk to a stance side as a user's leg is shifted from a swing phase to a stance phase by using an arm.

However, it is troublesome to wear this walking training apparatus, and this walking training apparatus provides only control at a periodical rhythm according to a predetermined walking pattern. It is therefore impossible to control a load in accordance with actual user's walking and to efficiently improve user's physical performance.

The inventors of the present invention found that it is possible to efficiently improve user's physical performance by estimating a leg position of a walking user on the basis of a force and setting a load applied to a user's leg portion in accordance with the estimated leg position.

In view of this, the inventors of the present invention accomplished the following disclosure.

A walking support robot according to an aspect of the present disclosure includes: a body; a handle that is on the body and configured to be held by a user; a sensor that senses a force applied to the handle; a moving device that includes a rotating member and moves the walking support robot by controlling rotation of the rotating member in accordance with the force sensed by the sensor; and a processor that, in operation, performs operations including: estimating a leg position of the user on a basis of a change of the force sensed by the sensor; and setting a load to be applied to the user on a basis of the leg position.

According to this configuration, it is possible to improve physical performance while supporting user's walking. Furthermore, it is possible to set a load in accordance with user's actual walking on the basis of information on a leg position, thereby efficiently improving user's physical performance.

The walking support robot may be configured such that the operations further include correcting the force on the basis of the leg position.

According to this configuration, it is possible to set a load applied to a user by correcting a force and thus controlling movement of the walking support robot. This makes it possible to efficiently improve user's physical performance.

The walking support robot may be configured such that the operations further include acquiring body information of the user, and in the setting the load, the load is set on a basis of the body information and the basis of the leg position.

According to this configuration, it is possible to set a load applied to a user on the basis of body information and information on a leg position, thereby efficiently improving user's physical performance.

The walking support robot may be configured such that the operations further include notifying the user of at least one of the body information, information on the leg position, and information on the load.

According to this configuration, a user can grasp daily body information, information on a leg position, or information on a load. This motivates the user to maintain and improve physical performance or calls user's attention during walking.

The walking support robot may be configured such that in the acquiring the body information, the body information is estimated on a basis of the force sensed by the sensor.

According to this configuration, it is possible to estimate body information from a force. It is therefore possible to more easily acquire body information.

The walking support robot may be configured such that the operations further include determining a muscle to which the load is to be applied on the basis of the body information and the leg position, and in the setting the load, the load is set in accordance with the determined muscle.

According to this configuration, it is possible to determine a muscle to which a load is to be applied, thereby efficiently improving physical performance.

The walking support robot may be configured such that the operations further include changing a radius of turn of the walking support robot on the basis of the body information and the basis of the leg position.

According to this configuration, it is possible to efficiently improve physical performance by changing a radius of turn during turning of the walking support robot.

The walking support robot may be configured such that the operations further include: generating guide information for guiding the user; and causing the moving device to move the walking support robot on a basis of the guide information, and in the setting the load, the load is set on the basis of the body information, the basis of the leg position, and the basis of the guide information.

According to this configuration, it is possible to set a load applied to a user on the basis of body information, information on a leg position, and guide information while the walking support robot autonomously moves so as to guide a user.

The walking support robot may be configured such that in the setting the load, the load is set by changing a guide distance over which the user is guided by the walking support robot in accordance with the basis of the leg position.

According to this configuration, it is possible to improve physical performance by changing a guide distance in accordance with a leg position.

The walking support robot may be configured such that the body information includes strides; and in the setting the load, the load is set on a basis of a difference between a stride of a left leg and a stride of a right leg.

According to this configuration, it is possible to efficiently train one of left and right legs that has a weaker muscular strength on the basis of a different in stride between the left and right legs.

The walking support robot may be configured such that in the setting the load, the load is set for each of a plurality of leg positions.

According to this configuration, it is possible to efficiently improve body information by setting a load for each leg position.

The walking support robot may be configured such that in the setting the load, the load is set further on a basis of a change of the force.

A walking support method according to an aspect of the present disclosure is a walking support method for supporting walking of a user by using a walking support robot, the walking support method including: causing a sensor to sense a force applied to a handle of the walking support robot; causing a moving device of the walking support robot to move the walking support robot in accordance with the force sensed by the sensor; estimating a leg position of the user on a basis of a change of the force; and setting a load to be applied to the user on a basis of the leg position.

According to this arrangement, it is possible to improve physical performance while supporting user's walking. Furthermore, it is possible to set a load in accordance with user's actual walking on the basis of information on a leg position, thereby efficiently improve user's physical performance.

The walking support method may be arranged such that in the setting the load, the force is corrected on the basis of the leg position.

According to this arrangement, it is possible to set a load applied to a user by correcting a force and thus controlling movement of the walking support robot.

The walking support method may be arranged to further include acquiring body information of the user.

According to this arrangement, it is possible to set a load applied to a user on the basis of body information and information on a leg position, thereby efficiently improving user's physical performance.

The walking support method may be arranged to further include notifying the user of at least one of the body information, information on the leg position, and information on the load.

According to this arrangement, a user can grasp daily body information, information on a leg position, or information on a load. This motivates the user to maintain and improve physical performance or calls user's attention during walking.

The walking support method may be arranged such that in the acquiring the body information, the body information is estimated on a basis of the force.

According to this arrangement, it is possible to estimate body information from a handle force. It is therefore possible to more easily acquire body information.

The walking support method may be arranged to further include determining a muscle to which the load is to be applied on a basis of the body information and the basis of the leg position, wherein, in the setting the load, the load is set in accordance with the determined muscle.

According to this configuration, it is possible to determine a muscle to which a load is to be applied, thereby efficiently improving physical performance.

The walking support method may be arranged to further include changing a radius of turn of the walking support robot on a basis of the body information and the basis of the leg position.

According to this configuration, it is possible to efficiently improve physical performance by changing a radius of turn.

The walking support method may be arranged to further include generating guide information for guiding the user; and causing the moving device to move the walking support robot on a basis of the guide information, wherein, in the setting the load, the load is set on a basis of the body information, the basis of the leg position, and the basis of the guide information.

According to this configuration, it is possible to set a load applied to a user on the basis of body information, information on a leg position, and guide information while the walking support robot autonomously moves so as to guide a user.

Embodiments of the present disclosure are described below with reference to the drawings. In each of the drawings, each element is illustrated in an exaggerated manner for easier understanding.

Embodiment 1

Overall Configuration

Figure 2:
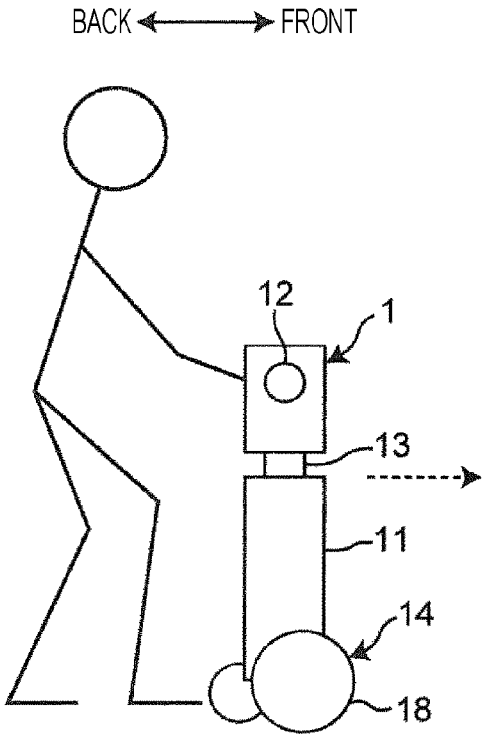
FIG. 2 illustrates how a user given walking support by the walking support robot according to Embodiment 1 of the present disclosure is walking.

FIG. 1 is a view illustrating external appearance of a walking support robot 1 (hereinafter referred to as a "robot 1") according to Embodiment 1. FIG. 2 illustrates how a user given walking support by the robot 1 is walking.

As illustrated in FIGS. 1 and 2, the robot 1 includes a body 11, a handle 12, a sensing unit 13, a moving device 14, a body information acquisition unit 15, a leg position estimating unit 16, and a load setting unit 17.

The body 11 is, for example, constituted by a frame having rigidity such that the body 11 can support other constituent members and support a weight applied while the user walks.

The handle 12 is provided on an upper part of the body 11 in a shape and at a height that allow the user who is walking to easily hold the handle 12 with both hands.

The sensing unit 13 senses a handle weight applied to the handle 12 by the user when the user holds the handle 12. Specifically, the user applies a handle weight to the handle 12 when the user walks while holding the handle 12. The sensing unit 13 senses direction and magnitude of the handle weight applied to the handle 12 by the user.

Figure 3:
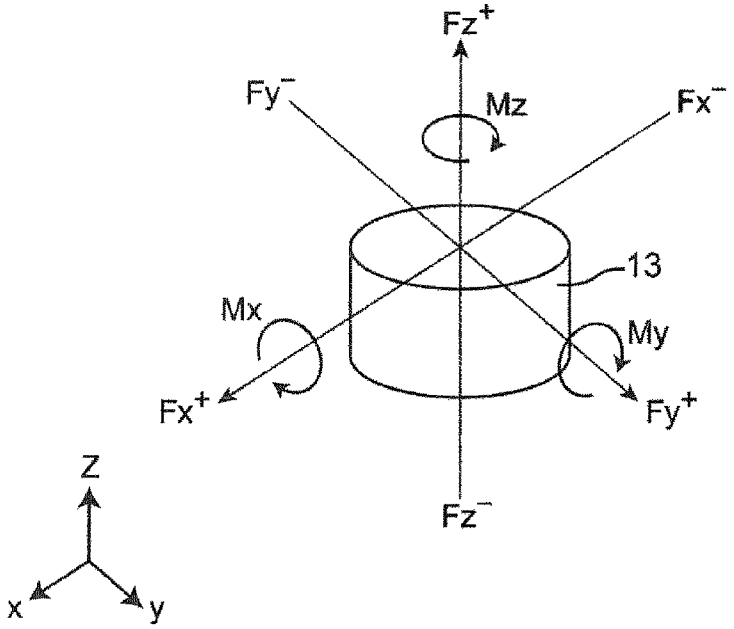
FIG. 3 illustrates a direction of sensing of a handle weight sensed by a sensing unit according to Embodiment 1 of the present disclosure.

FIG. 3 illustrates a direction of sensing of a handle weight sensed by the sensing unit 13. As illustrated in FIG. 3, the sensing unit 13 is a six-axis force sensor that is capable of detecting force applied in three-axis directions that are orthogonal to one another and moments around the three axes. The three axes that are orthogonal to one another are an x-axis extending in a left-right direction of the robot 1, a y-axis extending in a front-back direction of the robot 1, and a z-axis extending in a height direction of the robot 1. Force applied to the three-axis directions is force Fx applied in the x-axis direction, force Fy applied in the y-axis direction, and force Fz applied in the z-axis direction. In Embodiment 1, force Fx applied in a right direction is referred to as Fx+, and force Fx applied in a left direction is referred to as Fx−. Force Fy applied in a forward direction is referred to as Fy+, and force Fy applied in a backward direction is referred to as Fy−. Force Fz that is applied in a vertically downward direction with respect to a walking plane is referred to as Fz−, and force Fz applied to a vertically upward direction with respect to the walking plane is referred to as Fz+. The moments around the three axes are a moment Mx around the x-axis, a moment My around the y-axis, and a moment Mz around the z-axis.

The moving device 14 moves the body 11. The moving device 14 moves the body 11 on the basis of magnitude and direction of a handle weight (force and moment) sensed by the sensing unit 13. In Embodiment 1, the moving device 14 performs the following control operation. Hereinafter, Fx, Fy, Fz, Mx, My, and Mz are sometimes referred to as a weight.

Forward Moving Action

The moving device 14 moves the body 11 forward in a case where force Fy+ is sensed by the sensing unit 13. That is, in a case where Fy+ force is sensed by the sensing unit 13, the robot 1 moves forward. In a case where the Fy+ force sensed by the sensing unit 13 increases while the robot 1 is moving forward, the moving device 14 increases speed of the forward movement of the robot 1. Meanwhile, in a case where the Fy+ force sensed by the sensing unit 13 decreases while the robot 1 is moving forward, the moving device 14 decreases speed of the forward movement of the robot 1.

Backward Moving Action

The moving device 14 moves the body 11 backward in a case where Fy− force is sensed by the sensing unit 13. That is, in a case where Fy− force is sensed by the sensing unit 13, the robot 1 moves backward. In a case where the Fy− force sensed by the sensing unit 13 increases while the robot 1 is moving backward, the moving device 14 increases speed of the backward movement of the robot 1. Meanwhile, in a case where the Fy− force sensed by the sensing unit 13 decreases while the robot 1 is moving backward, the moving device 14 decreases speed of the backward movement of the robot 1.

Clockwise Turning Action

In a case where Fy+ force and Mz+ moment are sensed by the sensing unit 13, the moving device 14 causes the body 11 to turn in a clockwise direction. That is, in a case where Fy+ force and Mz+ moment are sensed by the sensing unit 13, the robot 1 turns in a clockwise direction. In a case where the Mz+ moment sensed by the sensing unit 13 increases while the robot 1 is turning in a clockwise direction, a radius of the turn of the robot 1 decreases. Meanwhile, in a case where the Fy+ force sensed by the sensing unit 13 increases while the robot 1 is turning in a clockwise direction, speed of the turn of the robot 1 increases.

Counterclockwise Turning Action

In a case where Fy+ force and Mz− moment are sensed by the sensing unit 13, the moving device 14 causes the body 11 to turn in a counterclockwise direction. That is, in a case where Fy+ force and Mz− moment are sensed by the sensing unit 13, the robot 1 turns in a counterclockwise direction. In a case where the Mz− moment sensed by the sensing unit 13 increases while the robot 1 is turning in a counterclockwise direction, a radius of the turn of the robot 1 decreases. Meanwhile, in a case where the Fy+ force sensed by the sensing unit 13 increases while the robot 1 is turning in a counterclockwise direction, speed of the turn of the robot 1 increases.

Note that control performed by the moving device 14 is not limited to the above example. The moving device 14 may control forward moving action and backward moving action of the robot 1, for example, on the basis of Fy force and Fz force. Furthermore, the moving device 14 may control a turning action of the robot 1, for example, on the basis of an Mx or My moment.

A handle weight used to calculate a moving speed may be a weight in the forward direction (Fy+), a weight in the downward direction (Fz−), or a combination of the weight in the forward direction (Fy+) and the weight in the downward direction (Fz−).

The moving device 14 includes a rotating member 18 that is provided below the body 11 and a driving unit 19 that controls the rotating member 18 to be driven.

The rotating member 18 is a wheel that supports the body 11 in a state where the body 11 stands by itself and is driven to rotate by the driving unit 19. In Embodiment 1, two rotating members 18 are rotated by the driving unit 19, and thus the robot 1 moves. Specifically, the rotating members 18 move the body 11 in a direction (the forward direction or the backward direction) indicated by the arrow in FIG. 2 while keeping the standing posture of the robot 1. In Embodiment 1, an example in which the moving device 14 includes a moving mechanism using two wheels as the rotating member 18 has been described. However, Embodiment 1 is not limited to this. For example, the rotating member 18 may be a travelling belt or a roller.

The driving unit 19 drives the rotating member 18 on the basis of a handle weight sensed by the sensing unit 13.

The body information acquisition unit 15 acquires user's body information. In Embodiment 1, the body information acquisition unit 15 includes, for example, a body information database in which user's body information is stored. The body information acquisition unit 15 acquires body information for each user from the body information database.

The body information as used herein refers to information on a body concerning walking, and examples of the body information include a walking speed, a walking rate, a body tilt, a body shake, a stride, and a muscular strength. The body information is not limited to these. For example, the body information may include an average weight in a moving direction, an average weight in a direction in which a center of gravity is deviated, a fluctuation frequency in a moving direction, a fluctuation frequency in the left-right direction, and the like concerning a handle weight.

The walking rate as used herein refers to the number of steps per unit time. The muscular strength is expressed by any of six evaluation levels (Levels 0 through 5) for each muscle (e.g., a tibialis anterior muscle, a peroneus muscle) of a leg portion used for each walking action of a user. A higher level indicates a stronger muscular strength. Note that the muscular strength is not limited to a muscular strength of the leg portion and may include, for example, a muscular strength related to a hip joint and a muscular strength related to a knee joint.

The leg position estimating unit 16 estimates a user's leg position. In Embodiment 1, the leg position estimating unit 16 estimates a user's leg position on the basis of a change in handle weight sensed by the sensing unit 13.

Estimation of a Leg Position Will be Described Later.

The user's leg position refers to a leg position of a walking user. Examples of the leg position include initial contact, loading response, mid stance, terminal stance, pre swing, initial swing, mid swing, and terminal swing. Note that the leg position is not limited to these, and examples of the leg position may include toe off, heel strike, heel off, acceleration, and deceleration.

The initial contact as used herein refers to a phase from a contact of a leg on a same side to a timing immediately after start of weight shift. The "same side" refers to one of left and right legs for which leg movement is noted. The loading response refers to a phase from a timing after contact of a leg on floor to a timing at which a leg on an opposite side leaves ground. Note that the "opposite side" refers to one of the left and right legs for which leg movement is not noted. The mid stance refers to a phase from start of swing of the leg on the opposite side to a timing at which a heel on the same side leaves ground. The terminal stance refers to a phase from the timing at which a heel on the same side leaves ground to initial contact of the leg on the opposite side. The initial contact, loading response, mid stance, and terminal stance include a period from a timing at which a leg of a walking user makes contact with ground to a timing at which the leg leaves ground.

The pre swing as used herein refers to a phase from initial contact of the leg on the opposite side to a timing at which a toe on the same side leaves ground. The initial swing refers to a phase from the timing at which the toe on the same side leaves ground to a timing at which the leg on the same side is lined up with the leg on the opposite side. The mid swing refers to a phase from the timing at which the leg on the same side is lined up with the leg on the opposite side to a timing at which a tibia bone on the same side becomes vertical. The terminal swing refers to the timing at which the tibia bone on the same side becomes vertical to initial contact on the same side.

The toe off as used herein refers to an instant at which a toe leaves ground. The heel strike refers to an instant at which a heel makes contact with ground. The heel off refers to an instant at which the heel leaves ground. The acceleration refers to a phase in which a toe leaves ground and is located behind a body trunk. The deceleration refers to a phase in which a leg is swung toward a front side of the body trunk.

In Embodiment 1, a user who is walking repeats these leg positions, i.e., the initial contact, loading response, mid stance, terminal stance, pre swing, initial swing, mid swing, and terminal swing. Hereinafter, a period from initial contact to terminal swing is referred to as a walking cycle.

The load setting unit 17 sets a load applied to a user. In Embodiment 1, the load setting unit 17 sets a load on the basis of body information and information on a leg position. For example, in a case where a muscular strength of a right leg is weaker than a muscular strength of a left leg, the load setting unit 17 may decrease driving force of the moving device 14 of the robot 1 during a period from initial contact to terminal stance of the right leg in order to train muscles of the right leg. Meanwhile, in a case where the muscular strength of the left leg is stronger than the muscular strength of the right leg, the load setting unit 17 may increase the driving force of the moving device 14 of the robot 1 during a period from initial contact to terminal stance of the left leg. Specifically, the load setting unit 17 controls the driving force of the moving device 14 by correcting a handle weight sensed by the sensing unit 13 and thus controls a load applied to the user. The moving device 14 moves at a moving speed corresponding to a handle weight sensed by the sensing unit 13. Therefore, the load setting unit 17 can change the moving speed of the moving device 14 by correcting the handle weight.

Control Configuration of Walking Support Robot

Figure 4:
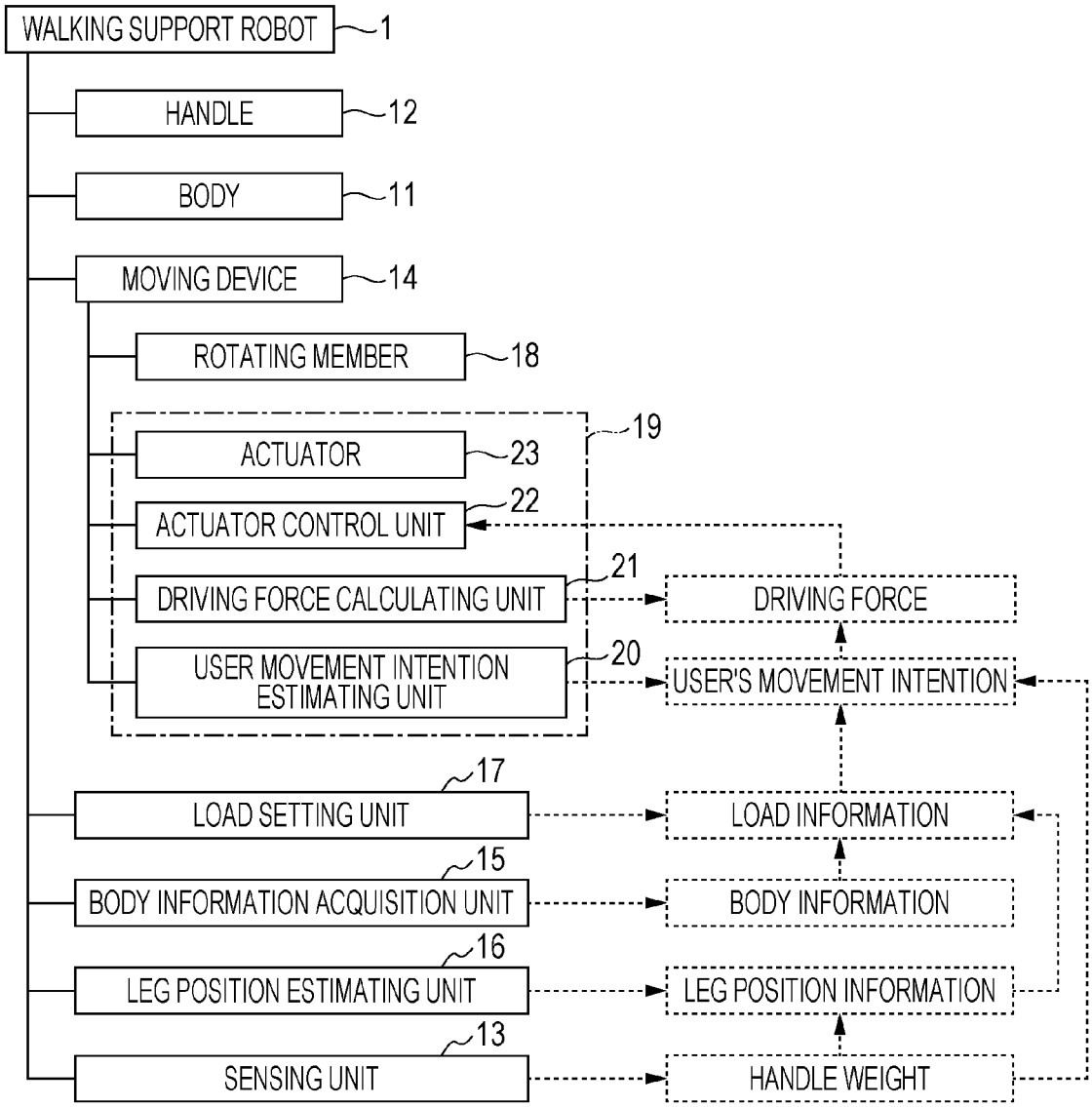
FIG. 4 is a control block diagram illustrating an example of a main control configuration of the walking support robot according to Embodiment 1 of the present disclosure.
Figure 5:
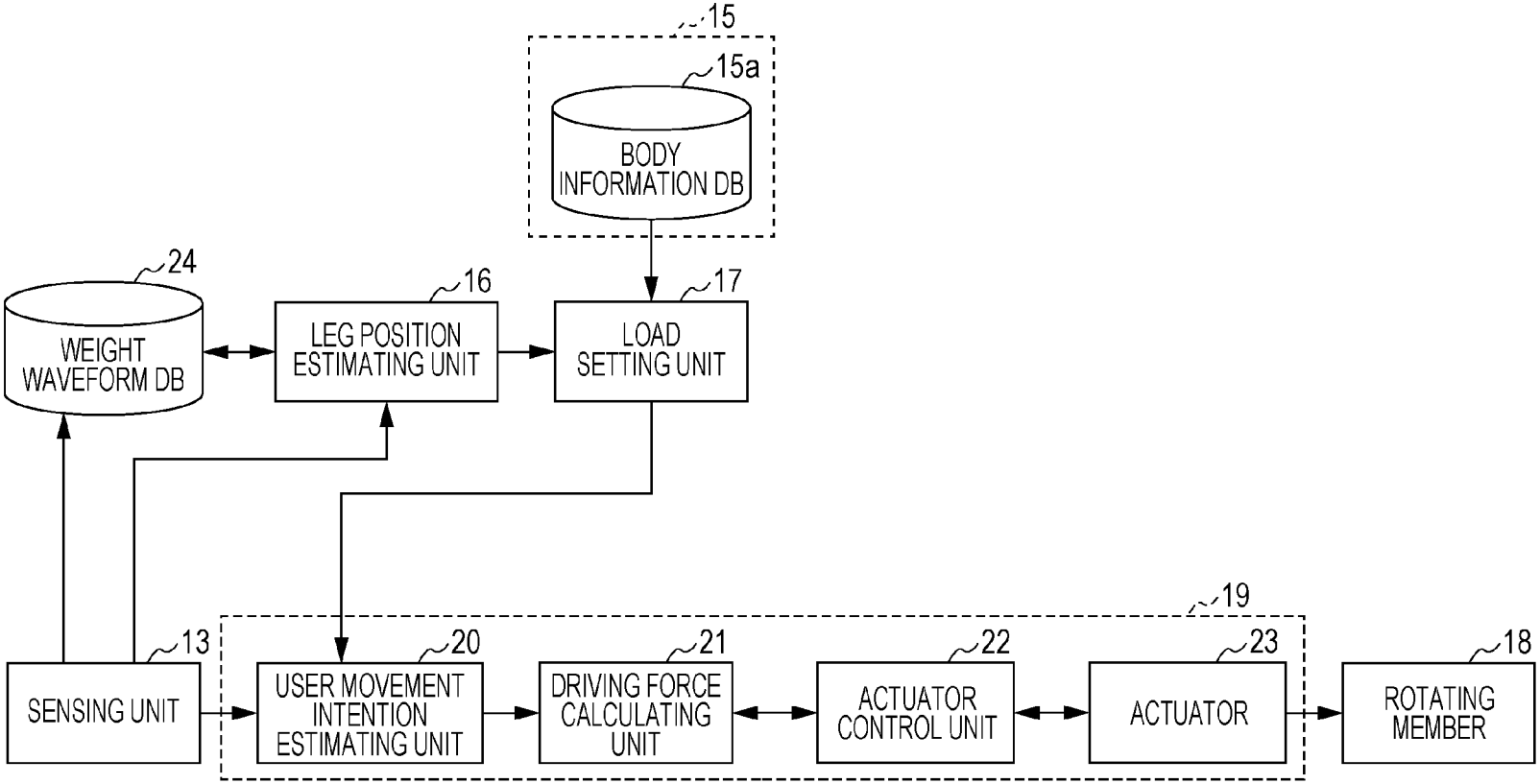
FIG. 5 is a control block diagram illustrating an example of a control configuration for walking support of the walking support robot according to Embodiment 1 of the present disclosure.

A control configuration for supporting user's walking in the walking support robot 1 having such a configuration is described below. FIG. 4 is a control block diagram illustrating a main control configuration in the robot 1. In the control block diagram of FIG. 4, a relationship between each control element and handled information is also illustrated. FIG. 5 is a control block diagram illustrating an example of a control configuration for walking support of the robot 1.

The driving unit 19 is described below. As illustrated in FIGS. 4 and 5, the driving unit 19 includes a user movement intention estimating unit 20, a driving force calculating unit 21, an actuator control unit 22, and an actuator 23.

The user movement intention estimating unit 20 estimates a user's movement intention on the basis of information on a handle weight sensed by the sensing unit 13. The user's movement intention includes a moving direction and a moving speed of the robot 1 that moves in accordance with the user's intention. In Embodiment 1, the user movement intention estimating unit 20 estimates a user's movement intention from a value of a handle weight in each moving direction sensed by the sensing unit 13. For example, in a case where the Fy+ force sensed by the sensing unit 13 is equal to or larger than a predetermined first threshold value and where the My+ force is less than a predetermined second threshold value, the user movement intention estimating unit 20 may estimate that the user's movement intention is a forward moving action. Furthermore, the user movement intention estimating unit 20 may estimate a moving speed on the basis of a value of a handle weight in the Fz direction. Meanwhile, in a case where the Fy+ force sensed by the sensing unit 13 is equal to or larger than a predetermined third threshold value and where the My+ force is equal to or larger than the predetermined second threshold value, the user movement intention estimating unit 20 may estimate that the user's movement intention is a clockwise turning action. Furthermore, the user movement intention estimating unit 20 may estimate a turning speed on the basis of a value of a handle weight in the Fz direction and estimate a radius of a turn on the basis of a value of a handle weight in the My direction.

The user movement intention estimating unit 20 may estimate a moving speed on the basis of a value of a handle weight corrected in accordance with a load set by the load setting unit 17. For example, in a case where the load setting unit 17 sets a load of −10N in the Fy direction during a right leg loading response phase, the user movement intention estimating unit 20 may estimate a moving speed by adding −10N to the handle weight sensed by the sensing unit 13.

In Embodiment 1, the user movement intention estimating unit 20 can also estimate a moving distance on the basis of information on a handle weight. Specifically, the user movement intention estimating unit 20 can estimate a moving distance on the basis of a moving speed and a period for which a handle weight is applied.

The driving force calculating unit 21 calculates driving force on the basis of the user's movement intention, i.e., user's moving direction and moving speed, estimated from information on a handle weight by the user movement intention estimating unit 20. For example, the driving force calculating unit 21 calculates driving force so that amounts of rotation of two wheels (rotating members) 18 become equal to each other in a case where the user's movement intention is a forward moving action or a backward moving action. The driving force calculating unit 21 calculates driving force so that an amount of rotation of a right one of the two wheels 18 becomes larger than an amount of rotation of a left one of the two wheels 18 in a case where the user's movement intention is a clockwise turning action. The driving force calculating unit 21 calculates magnitude of driving force in accordance with a user's moving speed.

The actuator control unit 22 controls driving of the actuator 23 on the basis of information on driving force calculated by the driving force calculating unit 21. Furthermore, the actuator control unit 22 can acquire information on amounts of rotation of the wheels 18 from the actuator 23 and transmit information on the amounts of rotation of the wheels 18 to the driving force calculating unit 21.

The actuator 23 is, for example, a motor that drives the wheels 18 to rotate. The actuator 23 is connected to the wheels 18 with a gear mechanism or a pulley mechanism interposed therebetween. The actuator 23 drives the wheels 18 to rotate while driving of the actuator 23 is controlled by the actuator control unit 22.

In Embodiment 1, the robot 1 may include a weight waveform database 24. The weight waveform database 24 stores therein a waveform of a handle weight sensed by the sensing unit 13. For example, the weight waveform database 24 stores therein, as waveform feature data, waveform information of a handle weight for each leg position of a user. The waveform feature data is data generated and updated on the basis of waveform information of a handle weight sensed by the sensing unit 13 and information on a leg position estimated by the leg position estimating unit 16. The waveform information of the handle weight stored in the weight waveform database 24 is transmitted to the leg position estimating unit 16.

In Embodiment 1, the waveform feature data is calculated by the leg position estimating unit 16 on the basis of information on a handle weight waveform concerning ten steps. For example, the leg position estimating unit 16 may detect handle weight waveform data for each leg position and calculate, as waveform feature data, data of an average weight waveform concerning ten steps at each leg position.

The waveform feature data is not limited to data of an average weight waveform concerning ten steps at each leg position and may be calculated, for example, on the basis of (data concerning ten steps)×(plural times) or handle weight waveform data concerning not less than one step to not more than ten steps or not less than ten steps. Furthermore, the waveform feature data is not limited to an average of handle weight waveform data and may be, for example, a median of handle weight waveform data.

Example of Body Information

An example of body information stored in a body information database 15*a* of the body information acquisition unit 15 is described. FIG. 6A illustrates an example of body information. As illustrated in FIG. 6A, a walking speed, a walking rate, a body tilt, a body shake, a stride, and a muscular strength of a leg portion may be used as body information of a user A.

FIG. 6B illustrates another example of body information. As illustrated in FIG. 6B, a walking speed, a walking rate, an average weight in a moving direction, an average weight in a direction in which a center of gravity is deviated, a fluctuation frequency in the moving direction, a fluctuation frequency in the left-right direction, a stride, and a muscular strength of a leg portion are used as body information of a forward moving action of the user A. The body information illustrated in FIG. 6B is a sum of handle weight input waveforms "No. 1" and "No. 3".

The muscular strength of the leg portion illustrated in FIGS. 6A and 6B may be calculated on the basis of manual muscle testing (MMT) or myoelectric data. The muscular strength of the leg portion may be calculated on the basis of a leg position or a deviation of a weight estimated from weight data sensed by the sensing unit 13. For example, in a case where it is determined that a weight is deviated toward a left side during an acceleration phase, a muscular strength of a muscle (e.g., a tibialis anterior muscle, a soleus muscle) of a left leg used during the acceleration phase is weaker than the muscular strength of the muscle of a right leg used during the acceleration phase, and therefore a calculated muscular level of the left leg is lower than that of the right leg.

Leg Position Estimating Process

Figure 7:
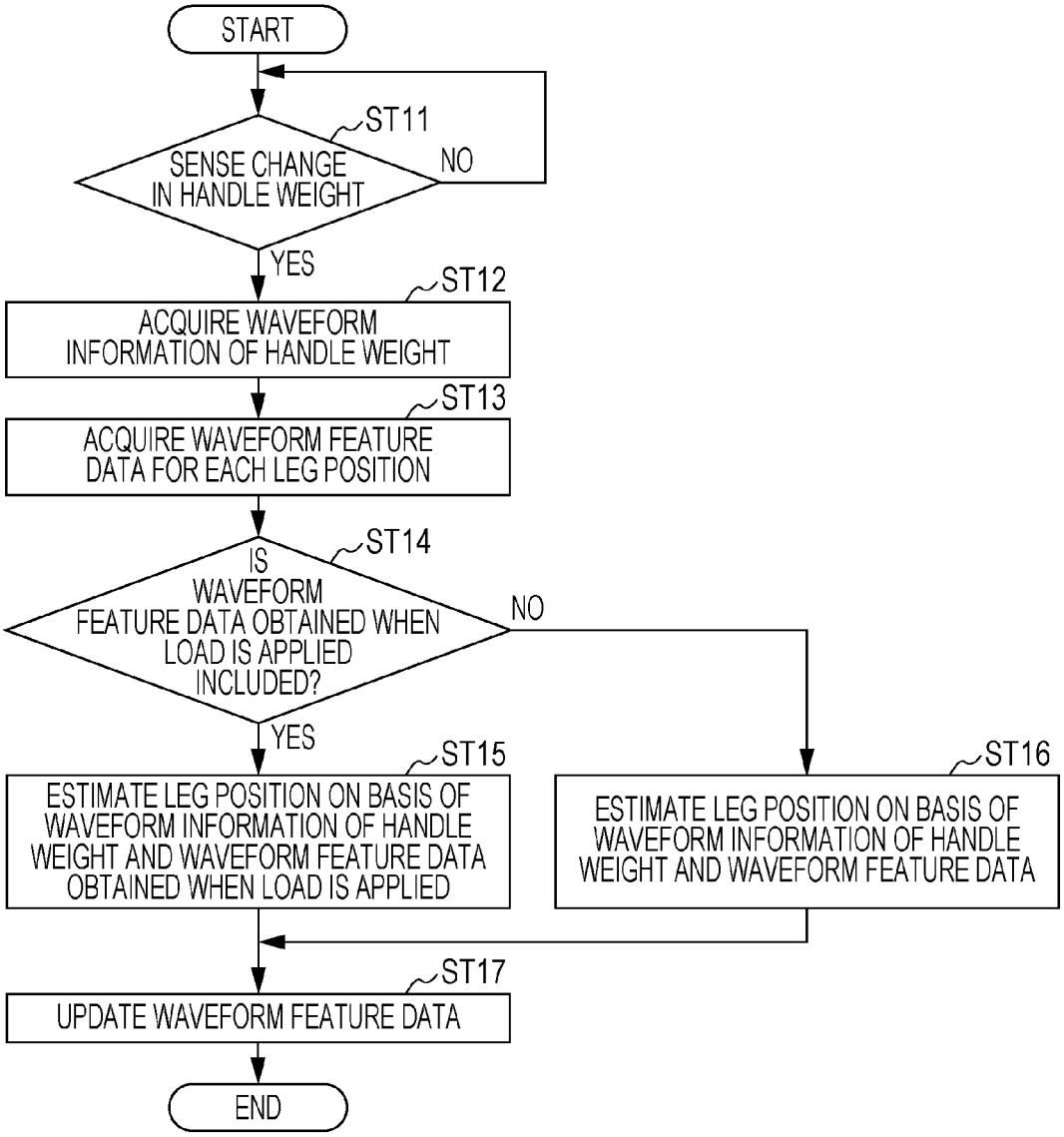
FIG. 7 is an exemplary flowchart of a leg position estimating process of the walking support robot according to Embodiment 1 of the present disclosure.

An example of a leg position estimating process based on a change in handle weight performed by the leg position estimating unit 16 is described. FIG. 7 is an exemplary flowchart of the leg position estimating process of the leg position estimating unit 16.

As illustrated in FIG. 7, in Step ST11, it is determined whether or not the sensing unit 13 has sensed a change in handle weight. In a case where the sensing unit 13 has sensed a change in handle weight, Step ST12 is performed. In a case where the sensing unit 13 has not sensed a change in handle weight, Step ST11 is repeated.

In Step ST12, the sensing unit 13 acquires waveform information of a handle weight. Specifically, the sensing unit 13 acquires waveform information of a handle weight by sensing the handle weight in real time. The waveform information of the handle weight acquired by the sensing unit 13 is transmitted to the leg position estimating unit 16.

In Step ST13, the leg position estimating unit 16 acquires waveform feature data for each leg position from the weight waveform database 24.

In Step ST14, the leg position estimating unit 16 determines whether or not the waveform feature data includes data obtained when a load set by the load setting unit 17 is applied. In a case where the waveform feature data includes the data obtained when the load is applied, Step ST15 is performed. In a case where the waveform feature data does not include the data obtained when the load is applied, Step ST16 is performed.

In Step ST15, the leg position estimating unit 16 estimates a leg position on the basis of the waveform information of the handle weight acquired in Step ST12 and the waveform feature data acquired in Steps ST13 and ST14. In Step ST15, the waveform feature data is the data obtained when the load is applied.

In Step ST16, the leg position estimating unit 16 estimates a leg position on the basis of the waveform information of the handle weight acquired in Step ST12 and the waveform feature data acquired in Steps ST13 and ST14. In Step ST16, the waveform feature data is data obtained when no load is applied.

In Step ST17, the leg position estimating unit 16 updates waveform feature data stored in the weight waveform database 24 on the basis of information on the leg position estimated in Step ST15 or ST16 and the waveform information of the handle weight.

Specific Example of Leg Position Estimating Process

A specific example of the leg position estimating process based on waveform information of a handle weight is described.

Figure 8:
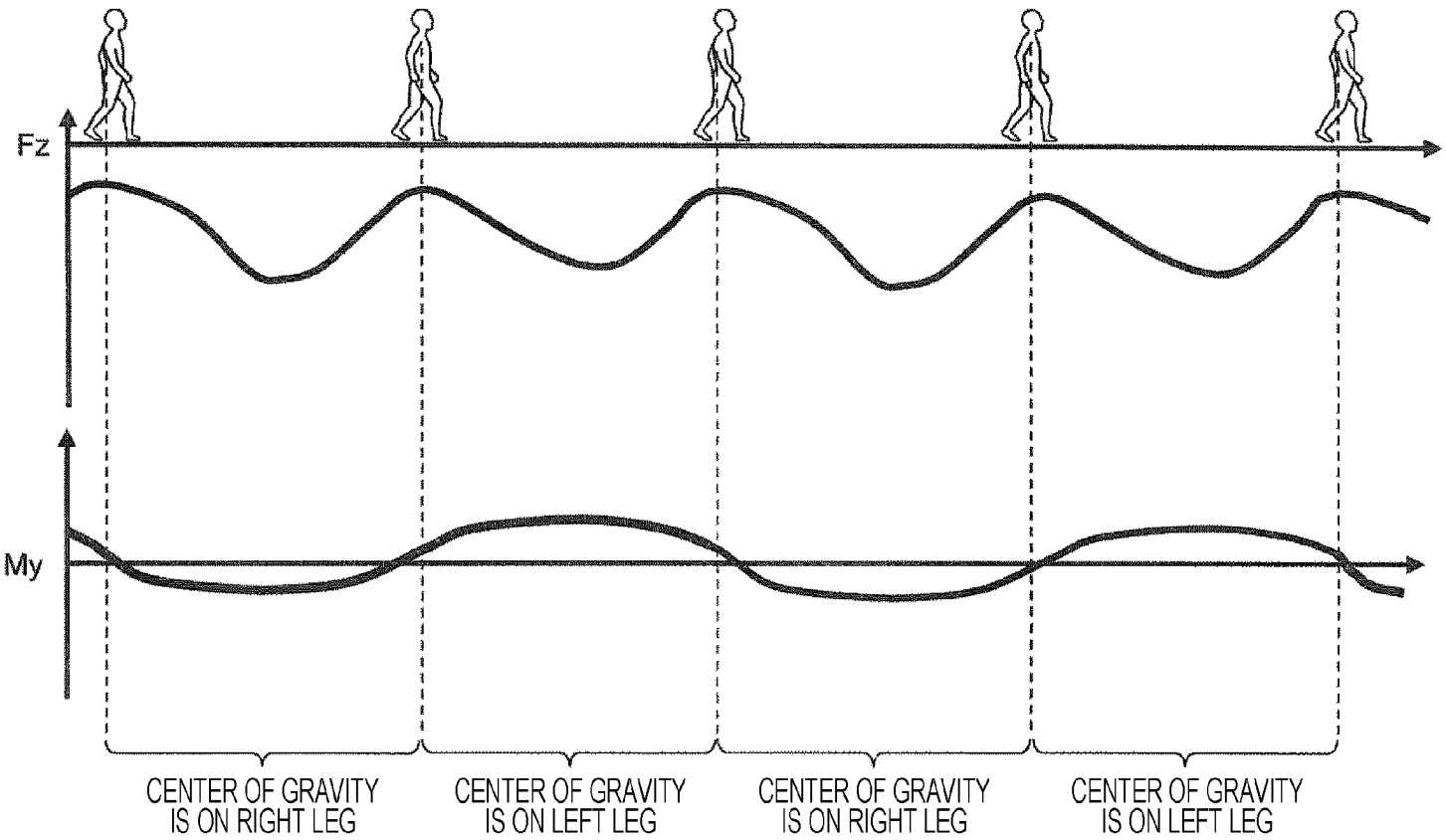
FIG. 8 illustrates an example of a relationship between waveform information of a handle weight and a walking cycle.

FIG. 8 illustrates an example of a relationship between waveform information of a handle weight and a walking cycle. FIG. 8 illustrates a change in weight in the Fz direction and a change in moment in the My direction concerning the handle weight during user's walking. As illustrated in FIG. 8, the weight in the Fz direction and the moment in the My direction fluctuate in accordance with the walking cycle. It is therefore possible to estimate a user's leg position on the basis of the waveform information of the handle weight.

For example, during a loading response phase, a user can support a weight mainly with a leg, and therefore the handle weight in the Fz− direction applied to the handle 12 is minimum. In other words, when a user's leg position is in the loading response phase, a waveform of the weight in the Fz direction has a peak position bulging in the Fz+ direction. The bulging peak position may be calculated, for example, on the basis of a point at which an amount of change of a handle weight changes from increase to decrease or may be calculated on the basis of a maximum value of a quadratic curve estimated by using a method of least squares.

In a case where a weight is supported by a left leg during a loading response phase, a center of gravity is on the left leg, and therefore a moment in the My+ direction is applied. Therefore, in a case where a moment is applied in the My+ direction, it can be estimated that the left leg is in contact with ground. Meanwhile, in a case where a weight is supported by a right leg, a center of gravity is on the right leg, and therefore a moment in the My− direction is applied. Therefore, in a case where a moment is applied in the My− direction, it can be estimated that the right leg is in contact with ground.

In Embodiment 1, the waveform information of the handle weight illustrated in FIG. 8 is an example, and waveform information of a handle weight is not limited to this. A relationship between a user's walking cycle and a waveform of a handle weight may vary depending on a user's age, physical performance, a size of a body, or the like. For example, a leg position corresponding to a peak position of a weight waveform in the Fz direction may be toe off.

The leg position estimating unit 16 may estimate a leg position on the basis of the relationship between a change of a waveform of a handle weight and a walking cycle.

Figure 9:
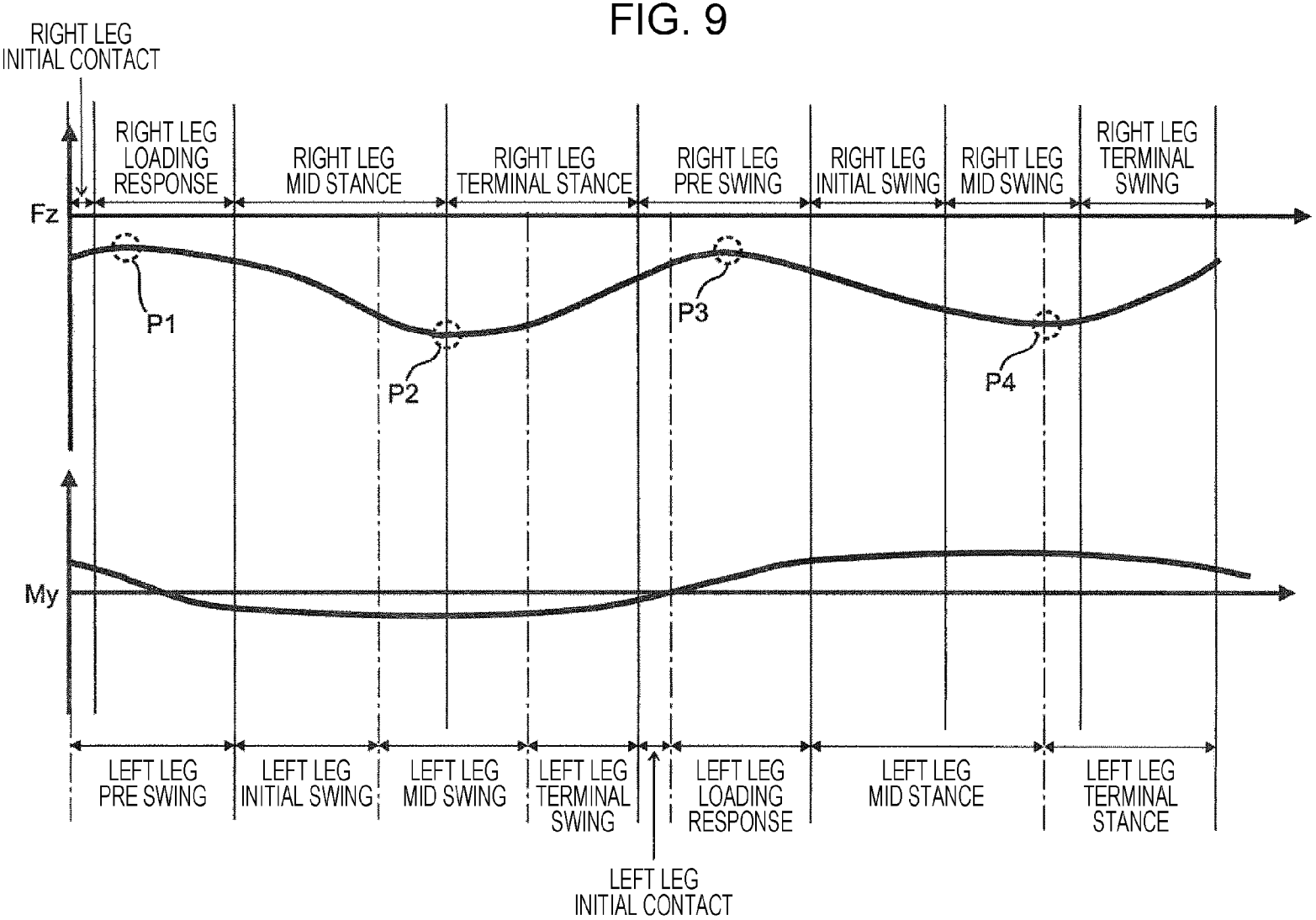
FIG. 9 illustrates an example of a relationship between waveform information of a handle weight and a leg position.

FIG. 9 illustrates an example of a relationship between a change in handle weight and a leg position. FIG. 9 illustrates a change in weight in the Fz direction and a change in moment in the My direction of a handle weight, and a leg position of a right leg and a leg position of a left leg relative to the change in handle weight.

As illustrated in FIG. 9, the leg position estimating unit 16 estimates a leg on which a center of gravity is on, on the basis of a direction in which the My moment is applied. That is, the leg position estimating unit 16 can estimate whether or not a leg supporting a weight is the left leg or the right leg on the basis of the direction in which the My moment is applied.

In FIG. 9, a relationship between a waveform of a handle weight and a leg position is described by focusing on a leg position of the right leg.

The leg position estimating unit 16 estimates initial contact and loading response on the basis of a peak position P1 bulging in the Fz+ direction in the Fz handle weight waveform as described above. For example, the leg position estimating unit 16 may estimate that a point immediately before the position P1 is initial contact and estimate that a period in which a handle weight applied in the Fz− direction gradually increases after the position P1 is loading response. In this case, the leg position estimating unit 16 estimates that the position of the right leg is initial contact or loading response since the My moment starts to apply in the My− direction.

The leg position estimating unit 16 estimates that a period after the loading response of the right leg to a peak position P2 bulging in the Fz− direction in the Fz handle weight waveform and in which period the handle weight in the Fz− direction increases is mid stance of the right leg.

The leg position estimating unit 16 estimates that a period after the mid stance of the right leg to a point immediately before the My moment becomes 0 is terminal stance of the right leg.

The leg position estimating unit 16 estimates that a period around a peak position P3 bulging in the Fz+ direction in the Fz handle weight waveform and in which period the My moment starts to apply in the My+ direction after terminal stance of the right leg is pre swing of the right leg.

The leg position estimating unit 16 estimates that a period after pre swing of the right leg to a point around a peak position P4 bulging in the Fz− direction in the Fz handle weight and in which period a moment in the My+ direction increases is initial swing of the right leg and mid swing of the right leg.

The leg position estimating unit 16 estimates that a period after mid swing of the right leg to initial contact of the right leg in which period the handle weight in the Fz− direction decreases is terminal swing of the right leg.

The aforementioned estimation of a position of a right leg by the leg position estimating unit 16 is an example, and estimation of a position of a right leg by the leg position estimating unit 16 is not limited to this. Estimation of a position of a left leg may be similar to or may be different from the estimation of a position of a right leg.

As described above, the leg position estimating unit 16 can estimate a user's leg position on the basis of waveform information of a sensed handle weight. Furthermore, the leg position estimating unit 16 can estimate a current leg position in real time on the basis of waveform information of a handle weight sensed in real time. Therefore, the leg position estimating unit 16 can estimate a next leg position on the basis of information on the estimated current leg position.

In Embodiment 1, initial contact, loading response, mid stance, terminal stance, pre swing, initial swing, mid swing, and terminal swing are repeated in a walking cycle. Therefore, in a case where the leg position estimating unit 16 estimates that a current leg position is initial contact, the leg position estimating unit 16 can estimate that a next leg position is loading response.

Information on a leg position estimated by the leg position estimating unit 16 is transmitted to the load setting unit 17. Therefore, the load setting unit 17 can set a load in real time on the basis of the information on the leg position estimated by the leg position estimating unit 16. For example, in a case where information on the estimated current leg position is loading response, the load setting unit 17 can determine that a next leg position is mid stance and change a load applied to a user to that set for mid stance.

Load Setting Process

Figure 10:
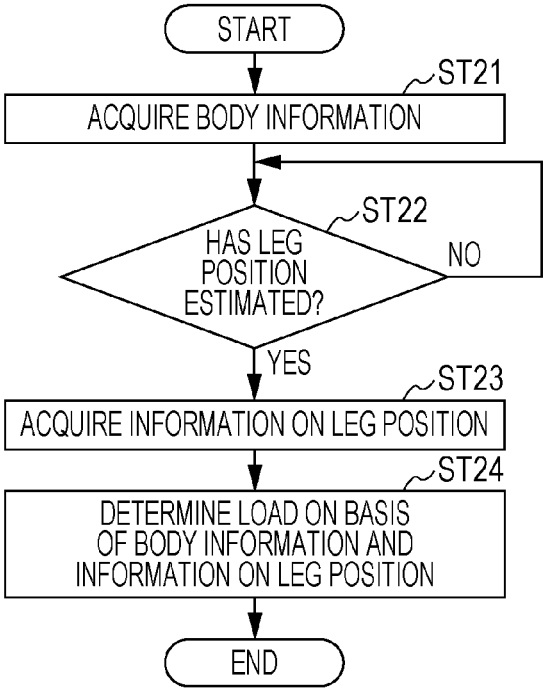
FIG. 10 is an exemplary flowchart of a load setting process of the walking support robot according to Embodiment 1 of the present disclosure.

An example of a load setting process of the load setting unit 17 is described below. FIG. 10 is an exemplary flowchart of the load setting process of the load setting unit 17.

As illustrated in FIG. 10, in Step ST21, the load setting unit 17 acquires body information. Specifically, the body information acquisition unit 15 acquires body information from the body information database 15*a* and transmits the body information to the load setting unit 17.

In Step ST22, it is determined whether or not the leg position estimating unit 16 has estimated a leg position. In a case where the leg position estimating unit 16 has estimated a leg position, Step ST23 is performed. In a case where the leg position estimating unit 16 has not estimated a leg position, Step ST22 is repeated until the leg position estimating unit 16 estimates a leg position.

In Step ST23, the load setting unit 17 acquires information on the leg position. Specifically, the leg position estimating unit 16 transmits the information on the leg position to the load setting unit 17.

In Step ST24, the load setting unit 17 sets a load applied to a user on the basis of the body information acquired in Step ST21 and the information on the leg position acquired in Step ST24. The load setting unit 17 transmits information on the set load to the user movement intention estimating unit 20.

Specifically, for example, the load setting unit 17 sets an intensity of the load on the basis of the body information. For example, the load setting unit 17 sets a load on the left leg larger than a load on the right leg in a case where it is determined that a muscular strength of the left leg is weaker than a muscular strength of the right leg. In Embodiment 1, the load setting unit 17 can set a load for each leg position.

Next, the load setting unit 17 sets a load on the basis of real-time information on a leg position estimated by the leg position estimating unit 16. For example, the load setting unit 17 sets a load corresponding to a current leg position on the basis of information on the estimated current leg position. Furthermore, the load setting unit 17 predicts a next leg position on the basis of the information on the current leg position. This allows the load setting unit 17 to set a load corresponding to a next leg position when the current leg position ends and the next leg position starts.

Specific Example of Load Setting Process

FIG. 11 illustrates an example of load setting. As illustrated in FIG. 11, in a case where a muscular strength of the tibialis anterior muscle of the left leg is "5" and a muscular strength of the tibialis anterior muscle of the right leg is "3", the load setting unit 17 sets a weight in the Fy direction during a period from initial contact to mid stance of the left leg to +10N. Meanwhile, the load setting unit 17 sets a weight in the Fy direction in initial contact, loading response, and mid stance of the right leg to −10N, −10N, and −15N, respectively. This makes it possible to reduce a load in movement of the robot 1 in the forward direction in a case where the user is walking while supporting a weight with the left leg, as compared with a case where the user is walking while supporting a weight with the right leg. Meanwhile, it is possible to increase a load in movement of the robot 1 in the forward direction in a case where the user is walking while supporting a weight with the right leg, as compared with a case where the user is walking while supporting a weight with the left leg.

Estimation of User's Movement Intention

Figure 12:
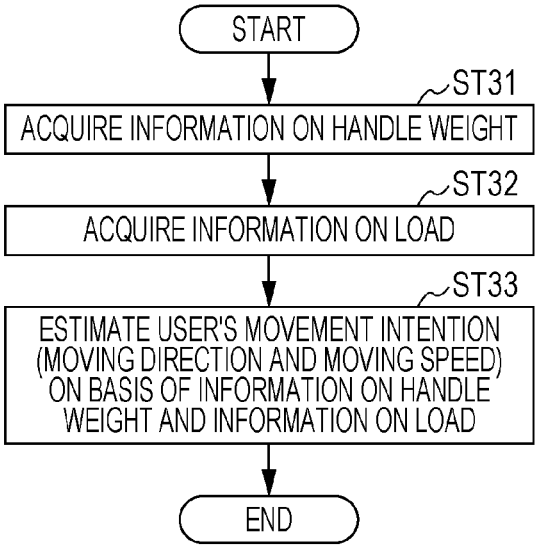
FIG. 12 is an exemplary flowchart of a user movement intention estimating process of the walking support robot according to Embodiment 1 of the present disclosure.

Estimation of a user's movement intention is described with reference to FIG. 12. FIG. 12 is an exemplary flowchart of a process for estimating a user's movement intention.

As illustrated in FIG. 12, in Step ST31, the user movement intention estimating unit 20 acquires information on a handle weight sensed by the sensing unit 13.

In Step ST32, the user movement intention estimating unit 20 acquires load information from the load setting unit 17.

In Step ST33, the user movement intention estimating unit 20 estimates a user's movement intention (a moving direction and a moving speed) on the basis of information on the handle weight acquired in Step ST31 and the load information acquired in Step ST32. Specifically, the user movement intention estimating unit 20 estimates a user's moving direction and moving speed on the basis of magnitude of force of the handle weight in Fx, Fy, Fz, Mx, My, and Mz directions and loads applied in these directions.

Calculation of Driving Force

Figure 13:
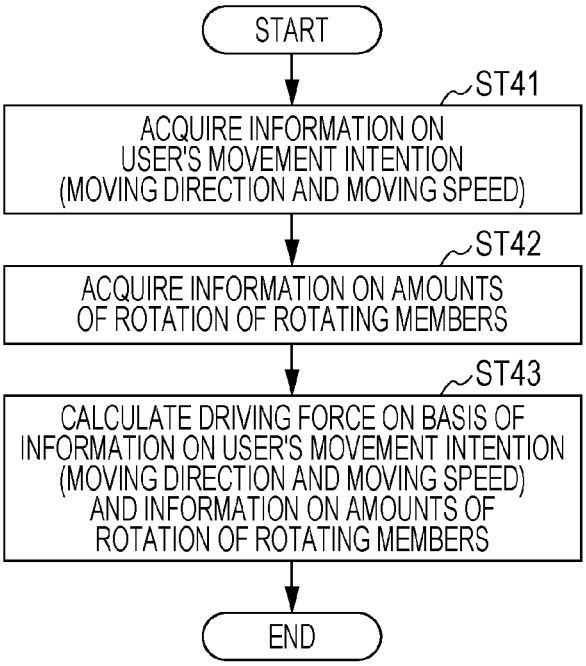
FIG. 13 is an exemplary flowchart of a driving force calculating process of the walking support robot according to Embodiment 1 of the present disclosure.

Calculation of driving force is described with reference to FIG. 13. FIG. 13 is an exemplary flowchart of a process for calculating driving force.

As illustrated in FIG. 13, in Step ST41, the driving force calculating unit 21 acquires information on a user's movement intention from the user movement intention estimating unit 20.

In Step ST42, the driving force calculating unit 21 acquires information on amounts of rotation of wheels 18 from the actuator control unit 22.

In Step ST43, the driving force calculating unit 21 calculates driving force on the basis of the user's movement intention acquired in Step ST41 and the information on amounts of rotation of the wheels 18. Specifically, the driving force calculating unit 21 calculates amounts of rotation of the wheels 18 on the basis of a difference between current moving direction and moving speed calculated from the information on the amounts of rotation of the wheels 18 and moving direction and moving speed estimated from the information on the user's movement intention.

An operation of the driving force calculating unit 21 in a case where a user accelerates a moving speed to 77 cm/s by increasing Fy+ force in a state where the robot 1 is moving forward at a moving speed of 71 cm/s is described below as an example. The driving force calculating unit 21 acquires information indicating that both of the amounts of rotation of the left and right wheels 18 are 2000 rpm in a state where the robot 1 is moving forward at a speed of 71 cm/s. Next, the driving force calculating unit 21 calculates that the amounts of rotation of the left and right wheels 18 need be 2500 rpm in order to accelerate the moving speed of the robot 1 to 77 cm/s. The driving force calculating unit 21 calculates driving force so that the amounts of rotation of the left and right wheels 18 are increased by 500 rpm.

Although an example in which the driving force calculating unit 21 calculates driving force on the basis of information on a user's movement intention and information on amounts of rotation of the wheels 18 acquired from the actuator control unit 22 has been described in Embodiment 1, Embodiment 1 is not limited to this. For example, the driving force calculating unit 21 may calculate driving force on the basis of only information on a user's movement intention. That is, Step ST42 is not essential in the process for calculating driving force.

Alternatively, the driving force calculating unit 21 may calculate driving force on the basis of a control table showing correspondences between handle weights and amounts of rotation of the wheels 18. Specifically, the driving force calculating unit 21 may include a storage unit in which a control table showing correspondences between handle weights and amounts of rotation of the wheels 18 is stored. The driving force calculating unit 21 may calculate amounts of rotation of the wheels 18 corresponding to a value of a handle weight sensed by the sensing unit 13 by using the control table stored in the storage unit.

Effects

According to the walking support robot 1 according to Embodiment 1, it is possible to produce the following effects.

According to the walking support robot 1, it is possible to improve physical performance while supporting user's walking. Furthermore, according to the robot 1, it is possible to set a load in accordance with user's actual walking on the basis of body information and information on a leg position, and it is therefore possible to efficiently improve user's physical performance.

The robot 1 saves the trouble of wearing an apparatus and is therefore more user-friendly.

Since a muscle of a leg portion used during walking varies depending on a leg position, it is possible to efficiently improve user's physical performance by setting a load in accordance with the leg position.

In the robot 1, the load setting unit 17 corrects a handle weight sensed by the sensing unit 13 in order to set a load applied to a user. The moving device 14 determines a moving speed and a moving direction in accordance with a value of the handle weight sensed by the sensing unit 13. Therefore, the load setting unit 17 can set a load applied to a user by correcting the handle weight and thus controlling movement of the robot 1.

In Embodiment 1, elements that constitute the robot 1 may include, for example, a memory (not illustrated) in which a program that causes these elements to function is stored and a processing circuit (not illustrated) corresponding to a processor such as a central processing unit (CPU), and these elements may function by execution of the program by the processor. Alternatively, the elements that constitute the robot 1 may be constituted by an integrated circuit that causes these elements to function.

Although operations of the walking support robot 1 have been mainly described in Embodiment 1, these operations may be executed as a walking support method.

Although an example in which the sensing unit 13 is a six-axis force sensor has been described in Embodiment 1, Embodiment 1 is not limited to this. The sensing unit 13 may be, for example, a three-axis sensor or a strain sensor.

Although an example in which the moving device 14 calculates a moving speed on the basis of a value of a user's handle weight has been described in Embodiment 1, Embodiment 1 is not limited to this. For example, the moving device 14 may calculate a moving speed on the basis of user's handle weight $\pm\alpha$. The value of $\pm\alpha$ may be, for example, a fixed value, a value set for each user, or a value input by a user.

Figure 14:
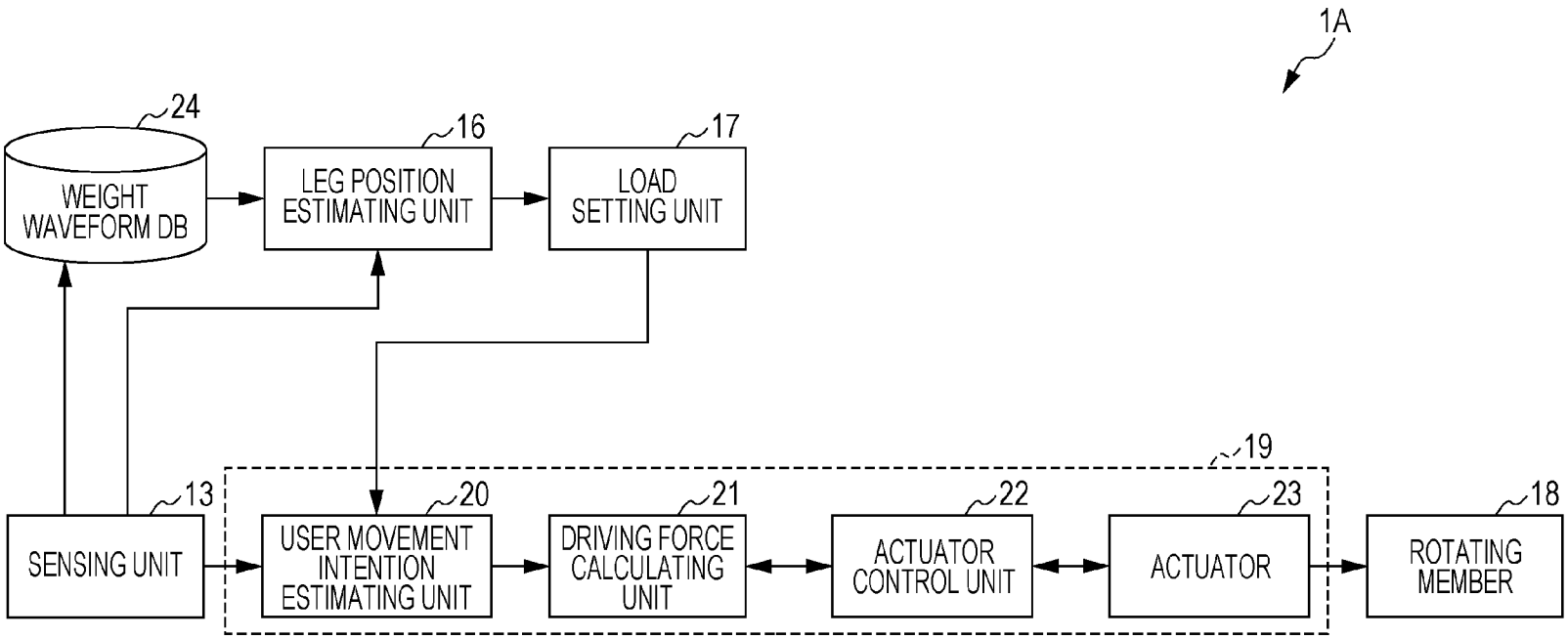
FIG. 14 is a control block diagram illustrating an example of a control configuration of a walking support robot according to a modification of Embodiment 1 of the present disclosure.

Although an example in which the robot 1 includes the body information acquisition unit 15 has been described in Embodiment 1, Embodiment 1 is not limited to this. FIG. 14 is a control block diagram illustrating an example of a control configuration of a robot 1A according to a modification of Embodiment 1. As illustrated in FIG. 14, the robot 1A is different from the robot 1 in that the robot 1A does not include the body information acquisition unit 15. Specifically, the robot 1A includes a body 11, a handle 12, a sensing unit 13, a moving device 14, a leg position estimating unit 16, and a load setting unit 17. In the robot 1A, the load setting unit 17 sets a load on the basis of information on a leg position without body information. For example, an intensity of a load may be a preset value. Alternatively, an intensity of a load may be manually input by using an input interface or may be automatically set by a computer. According to such a configuration, it is possible to set a load in accordance with user's actual walking on the basis of information on a leg position while supporting user's walking, thereby efficiently improving user's physical performance.

Although a muscular strength of a leg portion has been mainly described as body information in Embodiment 1, Embodiment 1 is not limited to this. The muscular strength may be, for example, a muscular strength of a crotch portion, a knee portion, or other portions, as long as the muscular strength is a muscular strength of a portion used for walking.

Although an example in which the robot 1 includes the body information database 15*a* and the weight waveform database 24 has been described in Embodiment 1, Embodiment 1 is not limited to this. The body information database 15*a* and the weight waveform database 24 may be provided in a server or the like. In this case, the robot 1 may acquire body information and weight waveform information from the body information database 15*a* and the weight waveform database 24, respectively by communicating with the server over a network.

Although an example in which the load setting unit 17 corrects a handle weight in order to set a load has been described in Embodiment 1, Embodiment 1 is not limited to this. For example, the load setting unit 17 may correct driving force calculated by the driving force calculating unit 21 by using a correction coefficient or may control amounts of rotation of the rotating members 18 in order to set a load. Alternatively, the load setting unit 17 may correct a radius of turn. Alternatively, the load setting unit 17 may set a load by combining these methods.

Although an example in which a forward moving action, a backward moving action, a clockwise turning action, a counterclockwise turning action, and the like of the robot 1 are controlled by setting amounts of rotation of the two wheels (rotating members) 18 has been described in Embodiment 1, Embodiment 1 is not limited to this. For example, an action of the robot 1 may be controlled by controlling the amounts of rotation of the wheels 18 by using a brake mechanism or the like.

Although an example in which the load setting unit 17 sets a load on the basis of muscular strengths of left and right legs has been described in Embodiment 1, Embodiment 1 is not limited to this. The load setting unit 17 may set a load on the basis of a difference between a stride of the left leg and a stride of the right leg. According to such a configuration, it is possible to easily determine which of the left and right legs has a weaker muscular strength, thereby making it possible to efficiently train the left and right legs.

Although an example in which the load setting unit 17 increases a load on one leg and decreases a load on the other leg on the basis of a difference in muscular strength between the left and right legs has been described in Embodiment 1, Embodiment 1 is not limited to this. For example, the load setting unit 17 may set loads on both of the legs large in a case where muscles of both of the legs are trained.

The load setting unit 17 may set a load on the basis of a change in handle weight. The load setting unit 17 can detect that a user is walking on the basis of a change in handle weight and can therefore set a load when user's walking is detected.

Although an example in which the user movement intention estimating unit 20 estimates a user's movement intention on the basis of a handle weight sensed by the sensing unit 13 has been described in Embodiment 1, Embodiment 1 is not limited to this. The user movement intention estimating unit 20 may estimate a user's movement intention on the basis of a corrected value (corrected handle weight) of the handle weight sensed by the sensing unit 13.

A handle weight may be corrected, for example, by calculating a fluctuation frequency from past handle weight data during user's walking and filtering out the fluctuation frequency from the handle weight sensed by the sensing unit 13. Alternatively, a handle weight may be corrected by using an average weight value of handle weights sensed by the sensing unit 13. Alternatively, a handle weight may be corrected on the basis of weight tendency data of a user. Alternatively, a handle weight value may be corrected on the basis of a place where the robot 1 is used, duration of use of the robot 1, a user's physical condition, or the like.

Although an example in which a load applied while the robot 1 is moving straight in a forward direction is set has been described in Embodiment 1, Embodiment 1 is not limited to this. For example, even in a case where the robot 1 is moving backward or is turning, a load may be set in a manner similar to the case where the robot 1 is moving straight in a forward direction. According to such a configuration, it is possible to set a load during various actions of the robot 1.

Embodiment 2

A walking support robot according to Embodiment 2 of the present disclosure is described. In Embodiment 2, differences from Embodiment 1 are mainly described. In Embodiment 2, constituent elements that are identical or similar to those in Embodiment 1 are given identical reference signs. In Embodiment 2, descriptions similar to those in Embodiment 1 are omitted.

Embodiment 2 is different from Embodiment 1 in that a body information estimating unit that estimates user's body information is provided.

Control Configuration of Walking Support Robot

Figure 15:
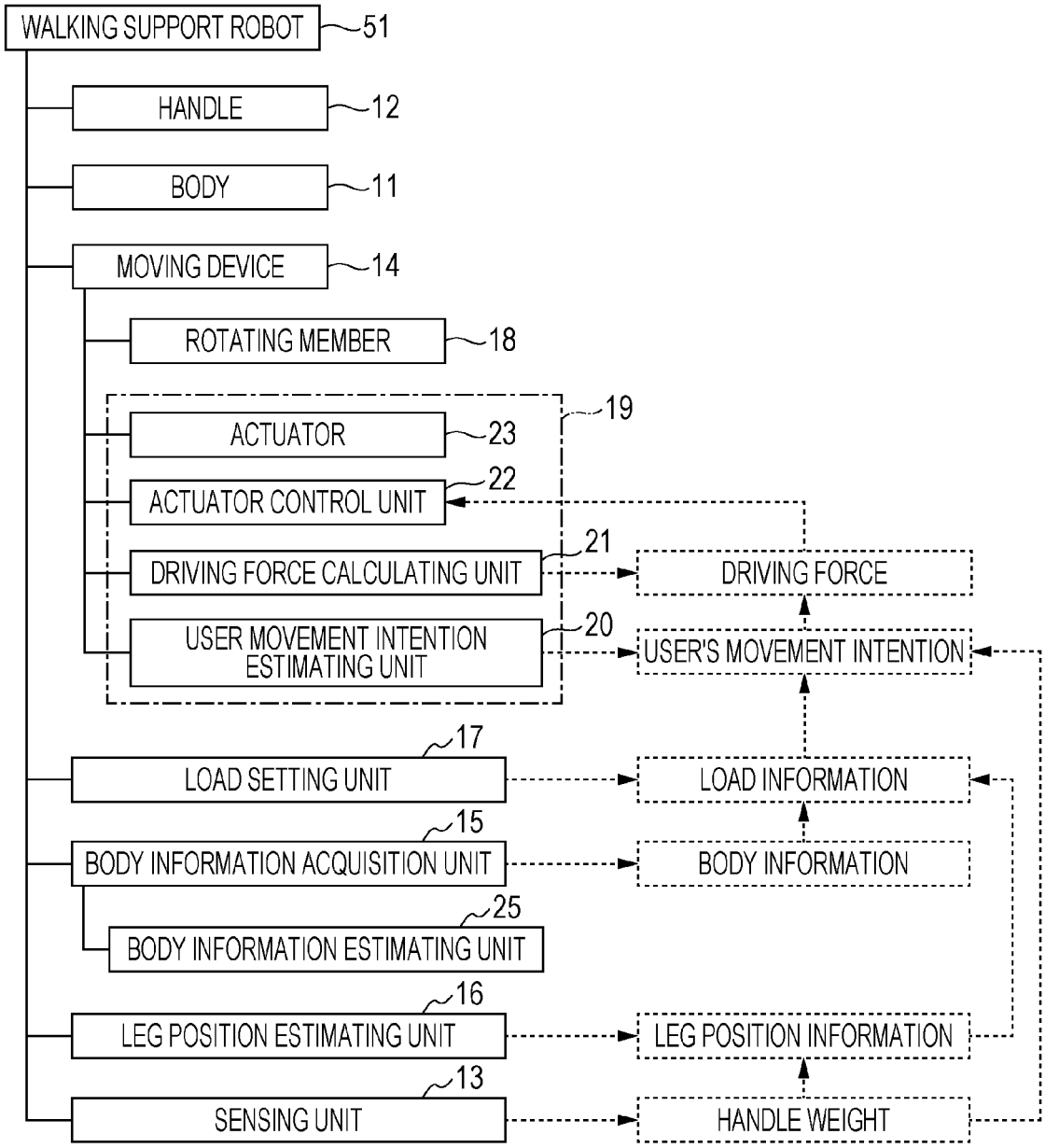
FIG. 15 is a control block diagram illustrating an example of a main control configuration of a walking support robot according to Embodiment 2 of the present disclosure.
Figure 16:
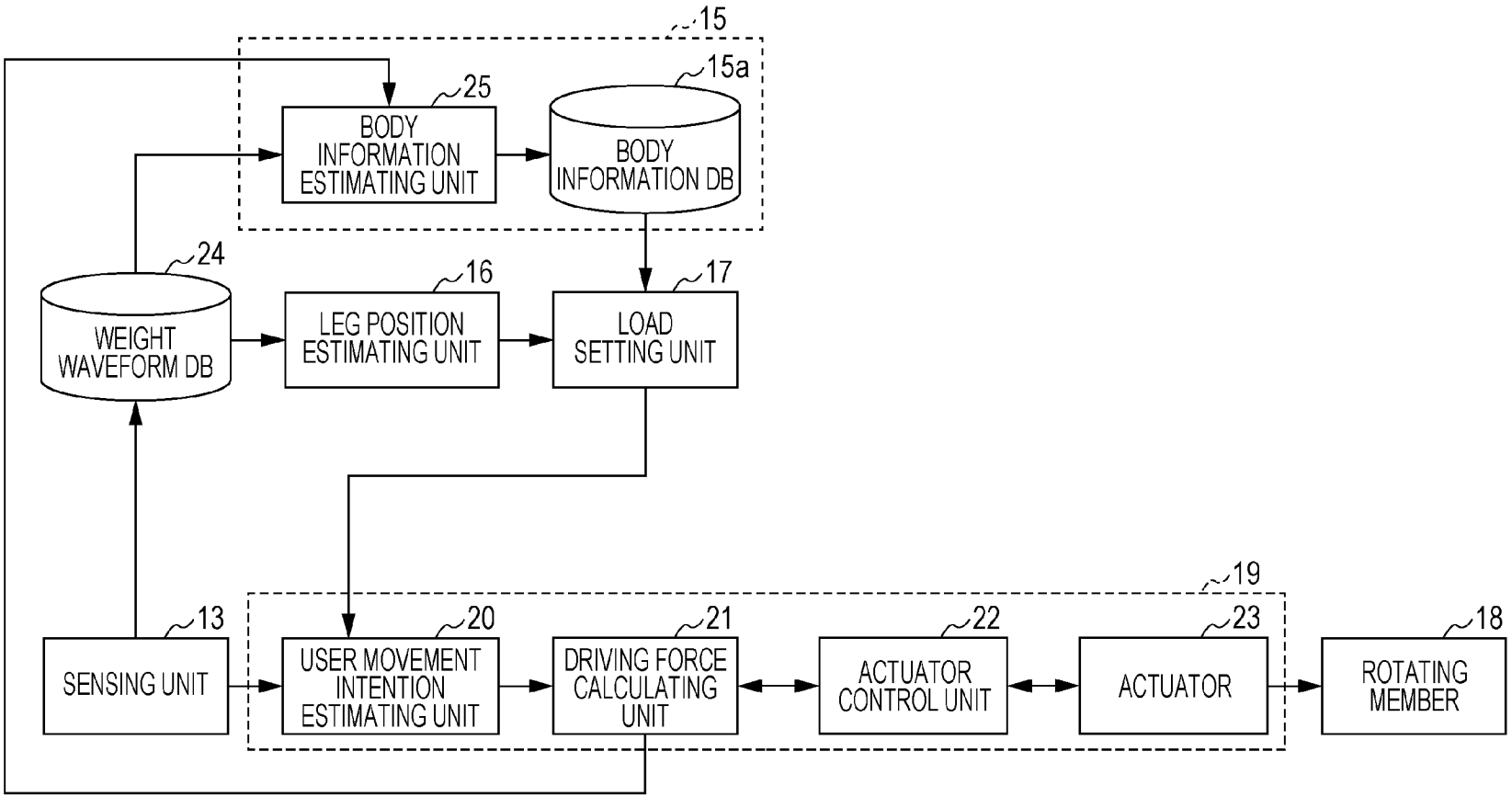
FIG. 16 is a control block diagram illustrating an example of a control configuration for walking support of the walking support robot according to Embodiment 2 of the present disclosure.

FIG. 15 is a control block diagram illustrating an example of a main control configuration of a walking support robot 51 (hereinafter referred to as a "robot 51") according to Embodiment 2. FIG. 16 is a control block diagram illustrating an example of a control configuration for walking support of the robot 51.

As illustrated in FIGS. 15 and 16, in Embodiment 2, a body information acquisition unit 15 includes a body information estimating unit 25.

The body information estimating unit 25 estimates user's body information. Specifically, the body information estimating unit 25 estimates body information on the basis of information on a handle weight sensed by the sensing unit 13.

For example, the body information estimating unit 25 can calculate a stride on the basis of information on a handle weight. For example, in a case where a user is moving straight, the user is walking while alternately swinging a right leg and a left leg forward. Waveform information of a handle weight of a user who is moving straight changes in tandem with a walking cycle. As described above, waveform information of a handle weight in an Fz direction has peak positions P1 and P3 bulging in an Fz+ direction during a loading response phase. The body information estimating unit 25 can estimate a stride by counting an interval between the peak position P1 and the peak position P3 as a single step and calculating a moving distance.

Furthermore, the body information estimating unit 25 estimates body information on the basis of not only information on a handle weight, but also information on driving force. For example, the body information estimating unit 25 calculates a moving distance on the basis of the information on the driving force and calculates a walking speed by dividing the moving distance by a moving period.

The body information estimated by the body information estimating unit 25 is transmitted to the body information database 15*a*.

Estimation of Body Information

Figure 17:
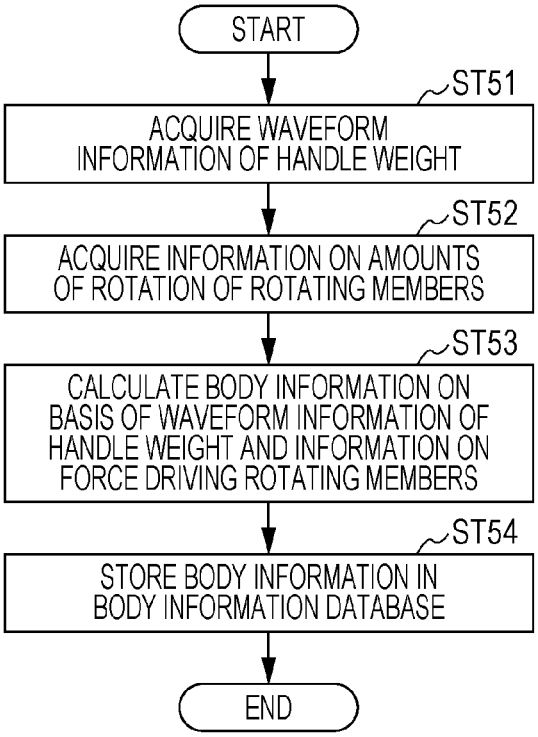
FIG. 17 is an exemplary flowchart of a body information estimating process of the walking support robot according to Embodiment 2 of the present disclosure.

Estimation of body information is described with reference to FIG. 17. FIG. 17 is an exemplary flowchart of a body information estimating process of the robot 51.

As illustrated in FIG. 17, in Step ST51, the body information estimating unit 25 acquires waveform information of a handle weight. Specifically, the body information estimating unit 25 acquires waveform information of a handle weight from a weight waveform database 24.

In Step ST52, the body information estimating unit 25 acquires information on force driving a rotating member 18. Specifically, the body information estimating unit 25 acquires information on driving force from a driving force calculating unit 21.

In Step ST53, the body information estimating unit 25 calculates body information on the basis of the waveform information of the handle weight acquired in Step ST51 and the information on the driving force acquired in Step ST52.

For example, the body information estimating unit 25 calculates a moving direction and a moving speed on the basis of the information on the driving force. The body information estimating unit 25 acquires waveform information of a handle weight corresponding to the user's moving direction from among the waveform information of the handle weight. For example, the body information estimating unit 25 acquires waveform information of a handle weight in an Fz direction and waveform information of a moment in an My direction in a case where the user's movement direction is an Fy+ direction.

Next, the body information estimating unit 25 estimates body information on the basis of the waveform information of the handle weight corresponding to the user's moving direction and the information on the driving force.

In Embodiment 2, the body information estimating unit 25 estimates a walking speed, a walking rate, a body tilt, a body shake, a stride, and a muscular strength as body information.

As described above, the walking speed is calculated by calculating a moving distance on the basis of the information on the driving force and dividing the moving distance by a moving period.

The walking rate is calculated by dividing the number of steps by the moving period. As described above, the number of steps is calculated by counting an interval from a peak position bulging in the Fz+ direction to a next peak position as a single step in the waveform information of the handle weight in the Fz direction.

The body tilt is calculated on the basis of the information on the handle weight. The body tilt is calculated on the basis of a deviation of a weight that occurs due to tilt of a center of gravity of a user. For example, as for a user walking in a state where a center of gravity is deviated rightward, a weight in the Fx+ direction is calculated as body tilt.

The body shake is calculated by calculating a fluctuation frequency on the basis of combined waveform information. Specifically, the body information estimating unit 25 calculates a fluctuation frequency by frequency analysis of a handle weight in the estimated user's moving direction.

As described above, the stride is calculated by counting an interval from a peak position to a next peak position as a single step in a waveform of a weight in the Fz direction and calculating a moving distance.

The muscular strength is calculated from a deviation of a weight value at each leg position, a difference in stride between left and right legs, a difference in moving amount between left and right legs, or the like. For example, the muscular strength is expressed by any of six evaluation levels (levels 0 through 5) for each muscle (e.g., tibialis anterior muscle, peroneus muscle) of a leg portion used for each walking action of a user. A higher level indicates a stronger muscular strength.

In Embodiment 2, the aforementioned data of body information is calculated on the basis of information concerning ten steps. Specifically, an average of data concerning ten steps is calculated as the body information. The body information is not limited to an average of the data concerning ten steps. For example, the body information may be calculated on the basis of data concerning not less than one step to less than ten steps, data concerning more than ten steps, or (data concerning ten steps)×(plural times). Furthermore, the body information is not limited to an average of data concerning ten steps and may be, for example, a median of data concerning ten steps.

In Step ST54, data of the body information calculated in Step ST53 is stored in the body information database 15*a*. The data of the body information stored in the body information database 15*a* is updated to new information every time body information is estimated.

In this way, the body information estimating unit 25 can estimate body information on the basis of information on a handle weight.

Effects

According to the walking support robot 51 according to Embodiment 2, it is possible to produce the following effects.

According to the robot 51, body information of a user can be estimated on the basis of information on a handle weight by the body information estimating unit 25. Therefore, the robot 51 can easily acquire body information of a user while supporting user's walking. Furthermore, it is possible to easily update body information stored in the body information database 15*a*.

According to the robot 51, it is possible to automatically acquire body information of a user on the basis of only information on a handle weight without burden of wearing an apparatus.

Furthermore, it is possible to properly give a load even in a case where body information minutely fluctuates from day to day by grasping body information every day.

Although an example in which the body information estimating unit 25 acquires waveform information of a handle weight from the weight waveform database 24 has been described in Embodiment 2, Embodiment 2 is not limited to this. The body information estimating unit 25 may acquire waveform information of a handle weight from the sensing unit 13.

Although an example in which the body information estimating unit 25 estimates body information on the basis of information on a handle weight and information on driving force has been described in Embodiment 2, Embodiment 2 is not limited to this. For example, the body information estimating unit 25 may estimate body information on the basis of information on a handle weight and an amount of rotation of the rotating member 18 measured by an actuator control unit 22.

User Notifying Unit

Figure 18:
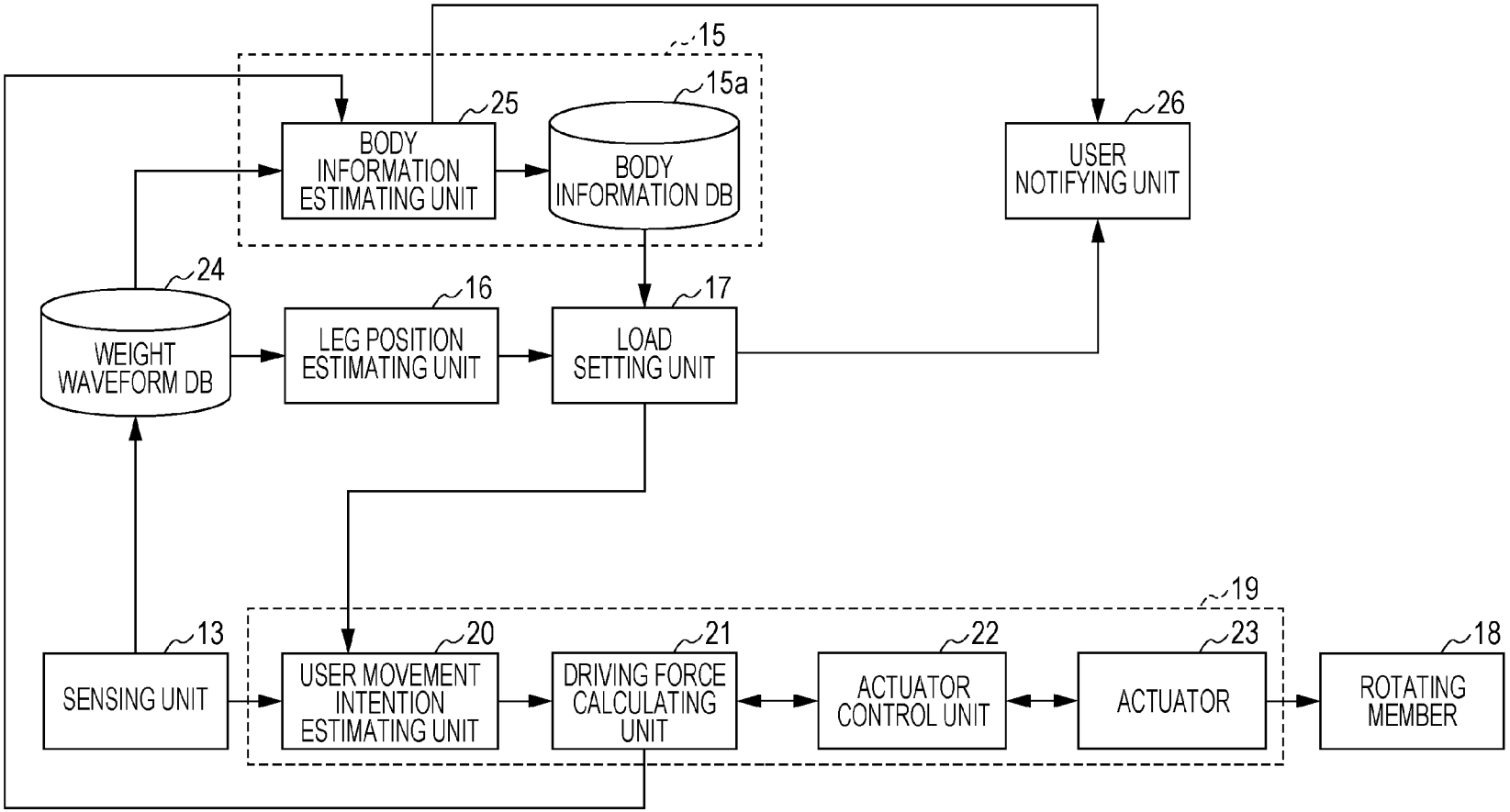
FIG. 18 is a control block diagram illustrating another example of a control configuration for walking support of the walking support robot according to Embodiment 2 of the present disclosure.

FIG. 18 is another control block diagram illustrating a control configuration of walking support of the robot 51. As illustrated in FIG. 18, the robot 51 may include a user notifying unit 26.

The user notifying unit 26 notifies a user of at least one of body information and load information. Specifically, the user notifying unit 26 acquires body information estimated from the body information estimating unit 25. Furthermore, the user notifying unit 26 acquires load information from the load setting unit 17.

The user notifying unit 26 is constituted, for example, by an LED, a display, or a speaker. The user notifying unit 26 may be constituted by an LED, a display, a speaker, or a combination thereof.

The following describes a case where the user notifying unit 26 has an LED. The user notifying unit 26 may turn on the LED, for example, when body information is acquired, when a leg position is estimated, or when a load is set. Information to be presented may be identified in accordance with a lighting pattern of the LED. For example, in a case where a load on a left leg is larger than a load on a right leg, the user notifying unit 26 may turn on the LED while the left leg is in a state from initial contact to terminal stance, and the user notifying unit 26 may turn off the LED while the right leg is in a state between initial contact and terminal stance. Alternatively, the user notifying unit 26 may change an intensity of light of the LED in stages in accordance with magnitude of a load.

The following describes a case where the user notifying unit 26 has a display. The user notifying unit 26 may display a message such as "your walking speed is ", "walking rate is ", or "muscular strength of right leg is weak" on the display when body information is acquired. The user notifying unit 26 may display a message such as "right leg initial contact", "right leg loading response", or "left leg initial swing" on the display when a leg position is estimated. The user notifying unit 26 may display a message such as "support that suits you will be given", "control will be changed in a way that suits you", "load will be increased", "load will be decreased", or "muscle will be trained" on the display when a load is set. Note that a message displayed on the display is not limited to these.

The following describes a case where the user notifying unit 26 has a speaker. The user notifying unit 26 may output voice such as "your walking speed is ", "walking rate is ", or "muscular strength of right leg is weak" by using the speaker when body information is acquired. The user notifying unit 26 may output voice such as "right leg initial contact", "right leg loading response", or "left leg initial swing" by using the speaker when a leg position is estimated. The user notifying unit 26 may output voice such as "support that suits you will be given", "control will be changed in a way that suits you", "brake will be increased", "shake will be kept small", or "stability will be provided" by using the speaker when a load is set. Note that voice output by using the speaker is not limited to these.

As described above, in a case where the user notifying unit 26 is provided, a user can acquire body information, information on a leg position, or information on a load by visual means and/or auditory means.

In a case where the user notifying unit 26 notifies a user of such information, the user can grasp daily body information, can be motivated to maintain and improve physical performance, or can be cautioned during walking.

Furthermore, in a case where the user notifying unit 26 notifies a user of such information, the user can grasp a control state of the robot 51 and can therefore adapt to a large change in feeling of operation such as an increase in load.

Embodiment 3

A walking support robot according to Embodiment 3 of the present disclosure is described below. In Embodiment 3, differences from Embodiment 1 are mainly described. In Embodiment 3, constituent elements that are identical or similar to those in Embodiment 1 are given identical reference signs. Furthermore, in Embodiment 3, descriptions similar to those in Embodiment 1 are omitted.

Embodiment 3 is different from Embodiment 1 in that a load target determining unit that determines a load target is provided.

Control Configuration of Walking Support Robot

Figure 19:
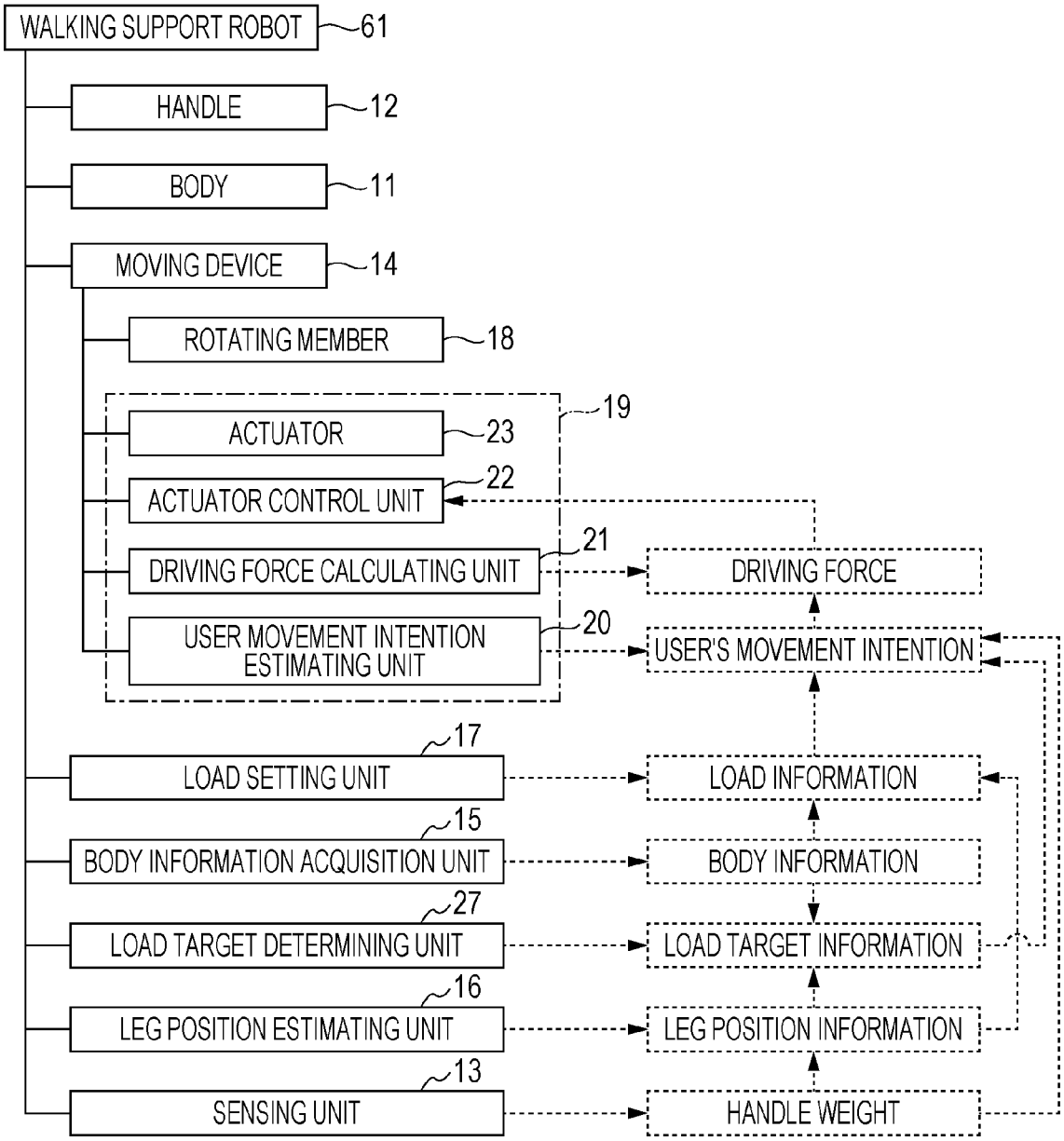
FIG. 19 is a control block diagram illustrating an example of a main control configuration of a walking support robot according to Embodiment 3 of the present disclosure.
Figure 20:
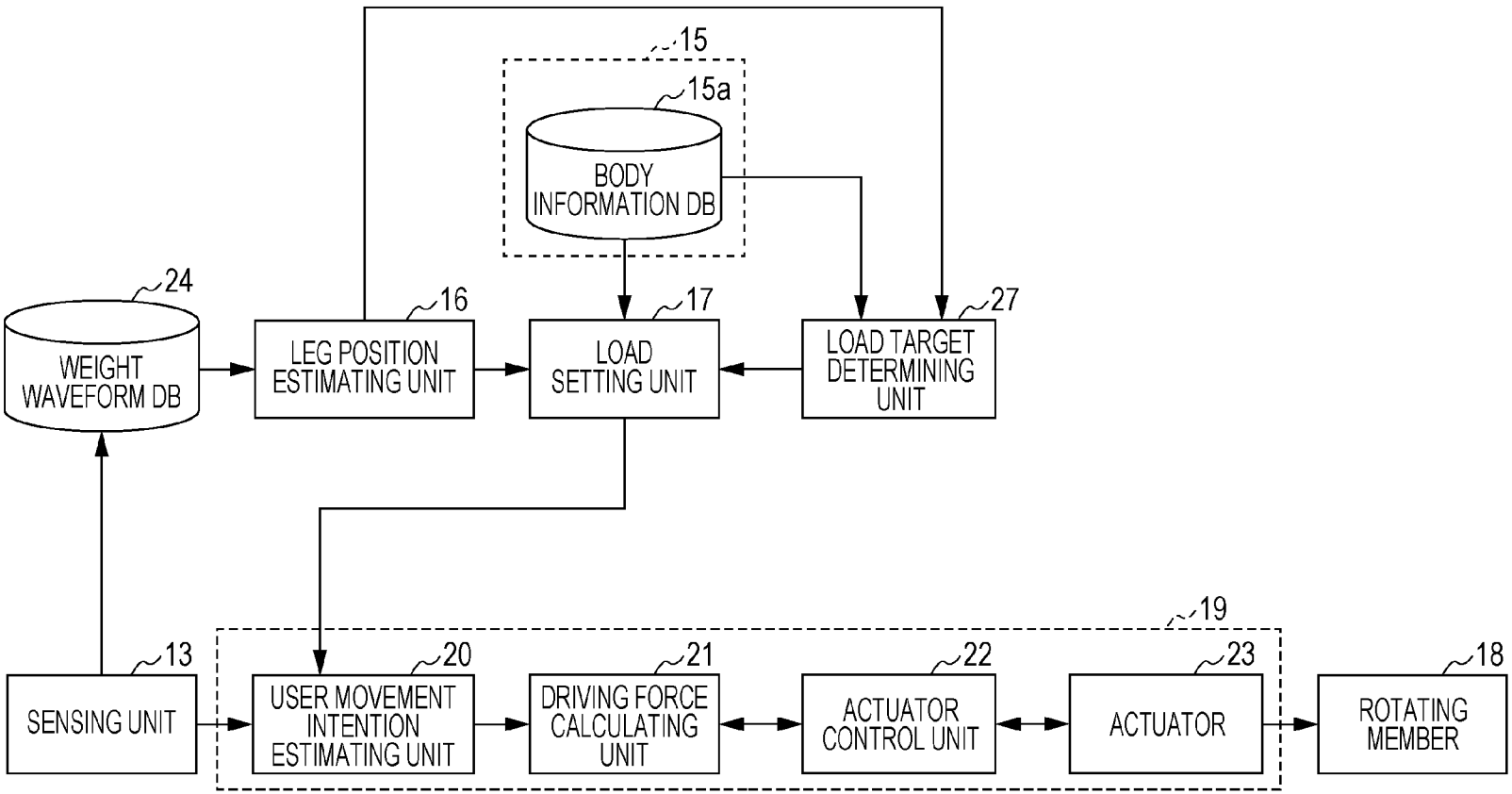
FIG. 20 is a control block diagram illustrating an example of a control configuration for walking support of the walking support robot according to Embodiment 3 of the present disclosure.

FIG. 19 is a control block diagram illustrating an example of a main control configuration of a walking support robot 61 (hereinafter referred to as a "robot 61") according to Embodiment 3. FIG. 20 is a control block diagram illustrating an example of a control configuration for walking support of the robot 61.

As illustrated in FIGS. 19 and 20, in Embodiment 3, the robot 61 includes a load target determining unit 27.

The load target determining unit 27 determines a target to which a load is applied. Specifically, the load target determining unit 27 determines a muscle to which a load is to be applied on the basis of body information. For example, the load target determining unit 27 determines that a load is to be given to a soleus muscle of a right leg in a case where it is determined that the soleus muscle of the right leg is weak on the basis of body information.

Determination of Load Target

Figure 21:
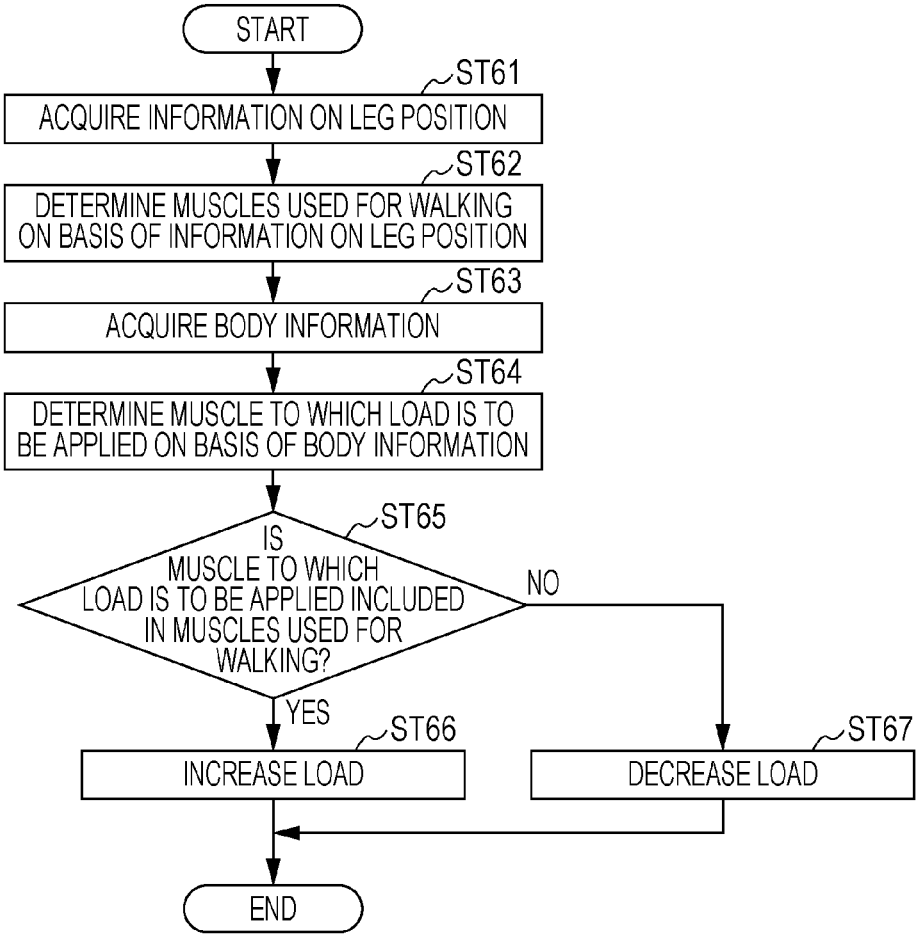
FIG. 21 is an exemplary flowchart of a load target determining process of the walking support robot according to Embodiment 3 of the present disclosure.

Determination of a load target is described with reference to FIG. 21. FIG. 21 is an exemplary flowchart of a load target determining process of the robot 61.

As illustrated in FIG. 21, in Step ST61, the load target determining unit 27 acquires information on a leg position from a leg position estimating unit 16.

In Step ST62, the load target determining unit 27 determines a muscle used for walking on the basis of the information on the leg position acquired in Step ST61. Specifically, the load target determining unit 27 determines a muscle corresponding to the estimated leg position by using a table showing a relationship between a leg position and a muscle used for walking.

FIGS. 22A and 22B each illustrate an example of a table showing a relationship between a leg position and a muscle used for walking. In FIGS. 22A and 22B, the white circles indicate a muscle used at a corresponding leg position. As illustrated in FIGS. 22A and 22B, a muscle used for walking varies depending on a leg position.

For example, as illustrated in FIG. 22A, in a case where a leg position is initial contact or loading response, a gluteus maximus muscle, an adductor magnus muscle, and a biceps femoris muscle of a crotch portion, a vastus intermedius muscle, a vastus medialis muscle, and a vastus lateralis muscle of a knee portion, and a soleus muscle, an extensor digitorum longus muscle, and an extensor hallucis longus muscle of a leg portion are used. In a case where a leg position is mid stance or terminal stance, the muscles of the crotch portion and the knee portion are not used, and the soleus muscle of the leg portion is used. As illustrated in FIG. 22B, in a case where a leg position is heel strike, the gluteus maximus muscle, the adductor magnus muscle, and the biceps femoris muscle of the crotch portion, the vastus intermedius muscle, the vastus medialis muscle, and the vastus lateralis muscle of the knee portion, and the soleus muscle, the extensor digitorum longus muscle, and the extensor hallucis longus muscle of the leg portion are used. In a case where a leg position is heel off, the muscles of the crotch portion and the knee portion are not used, and the soleus muscle of the leg portion is used.

As described above, the load target determining unit 27 determines a muscle of the crotch portion, knee portion, or the leg portion used for walking on the basis of information on a leg position by using a table like the ones illustrated in FIGS. 22A and 22B.

In Step ST63, the load target determining unit 27 acquires body information from a body information acquisition unit 15.

In Step ST64, the load target determining unit 27 determines a muscle to which a load is to be applied on the basis of the body information acquired in Step ST63. For example, the load target determining unit 27 determines that a load is to be applied to a soleus muscle of a right leg in a case where it is determined that the soleus muscle of the right leg is weaker than a soleus muscle of a left leg on the basis of the body information.

In Step ST65, the load target determining unit 27 determines whether or not the muscle to which a load is to be applied determined in Step ST64 is included in the muscle used for walking determined in Step ST62. In a case where it is determined that the muscle to which a load is to be applied is included in the muscle used for walking, Step ST66 is performed. In a case where the muscle to which a load is to be applied is not included in the muscle used for walking, Step ST67 is performed.

For example, assume that a leg position is loading response, it is determined that the soleus muscle, the extensor digitorum longus muscle, and the extensor hallucis longus muscle of the leg portion are used for walking, and it is determined that a load is to be applied to the soleus muscle of the right leg. In this case, the load target determining unit 27 determines that the soleus muscle is included in the muscles used for walking, and Step ST66 is performed.

Next, assume that a leg position is pre swing, it is determined that the extensor digitorum longus muscle and the extensor hallucis longus muscle of the leg portion are used for walking, and it is determined that a load is to be applied to the soleus muscle of the right leg. In this case, the load target determining unit 27 determines that the soleus muscle is not included in the muscles used for walking, and Step ST67 is performed.

In Step ST66, the load setting unit 17 increases a load applied to the muscle used for walking at the estimated leg position. Specifically, the load setting unit 17 decreases a handle weight applied in a user's travelling direction.

For example, in a case where a user is moving straight, the load setting unit 17 decreases a handle weight applied in an Fy+ direction. By decreasing the handle weight, it is possible to make the robot 61 harder to move and thereby increase a load applied in the user's travelling direction. That is, in a case where the load is increased, the user applies a larger handle weight in order to move the robot 61 than in a case where the handle weight is not decreased.

In Step ST67, the load setting unit 17 decreases a load applied to the muscle used for walking at the estimated leg position. Specifically, the load setting unit 17 increases a handle weight applied in the user's travelling direction.

For example, in a case where the user is moving straight, the load setting unit 17 increases a handle weight applied in the Fy+ direction. By increasing the handle weight, it is possible to make the robot 61 easier to move and thereby decrease a load applied in the user's travelling direction. That is, in a case where the load is decreased, the user can move the robot 61 with a smaller handle weight than in a case where the handle weight is not increased.

As described above, the load target determining unit 27 can determine a target to which a load is applied on the basis of information on a leg position and body information. Furthermore, the load setting unit 17 sets a load for each leg position in accordance with the determined target.

Effects

According to the walking support robot 61 according to Embodiment 3, it is possible to produce the following effects.

According to the robot 61, it is possible to determine a target to which a load is to be applied on the basis of information on a leg position and body information and to set a load for each leg position in accordance with the determined target. This makes it possible to efficiently improve physical performance.

Although an example in which a target to which a load is to be applied is muscles of a crotch portion, a knee portion, and a leg portion used for walking has been described in Embodiment 3, Embodiment 3 is not limited to this. The target to which a load is to be applied may be any target for which physical performance should be improved.

Although an example in which the load setting unit 17 decreases a handle weight applied in a user's travelling direction in a case where the load target determining unit 27 determines that a muscle to which a load is to be applied is included in muscles used for walking has been described in Embodiment 3, Embodiment 3 is not limited to this. For example, in Step ST66, the load setting unit 17 may increase a handle weight applied in the user's travelling direction. This makes it easier for the robot 61 to move, thereby increasing a user's stride. As a result, it is possible to increase a load.

Although an example in which the load setting unit 17 increases a handle weight applied in a user's travelling direction in a case where the load target determining unit 27 determines that a muscle to which a load is to be applied is not included in muscles used for walking has been described in Embodiment 3, Embodiment 3 is not limited to this. For example, in Step ST67, the load setting unit 17 need not set a load.

Embodiment 4

A walking support robot according to Embodiment 4 of the present disclosure is described below. In Embodiment 4, differences from Embodiment 1 are mainly described. In Embodiment 4, constituent elements that are identical or similar to those in Embodiment 1 are given identical reference signs. In Embodiment 4, descriptions similar to those in Embodiment 1 are omitted.

Embodiment 4 is different from Embodiment 1 in that a turning load setting unit that sets a turning load is provided.

Control Configuration of Walking Support Robot

Figure 23:
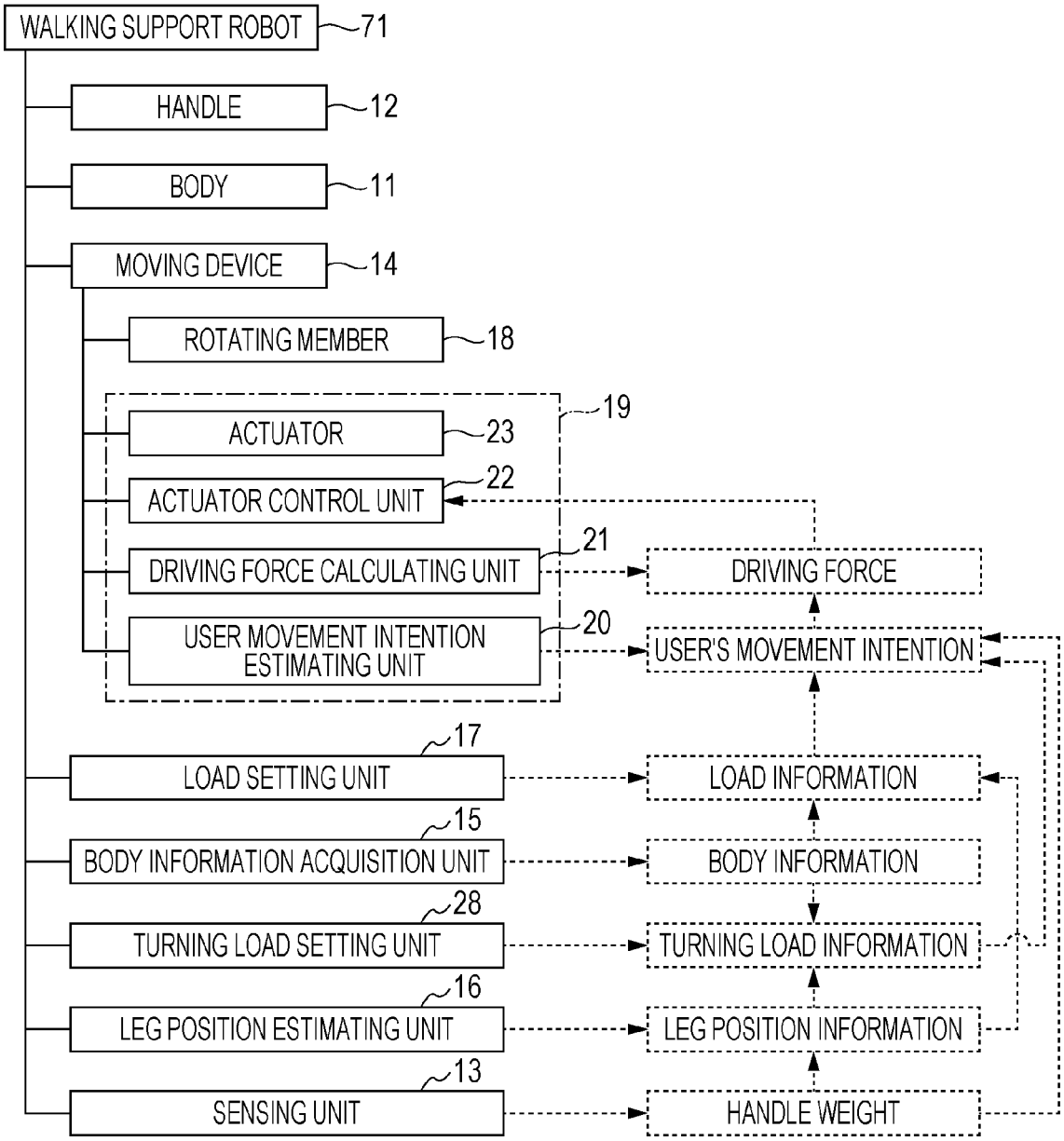
FIG. 23 is a control block diagram illustrating an example of a main control configuration of a walking support robot according to Embodiment 4 of the present disclosure.
Figure 24:
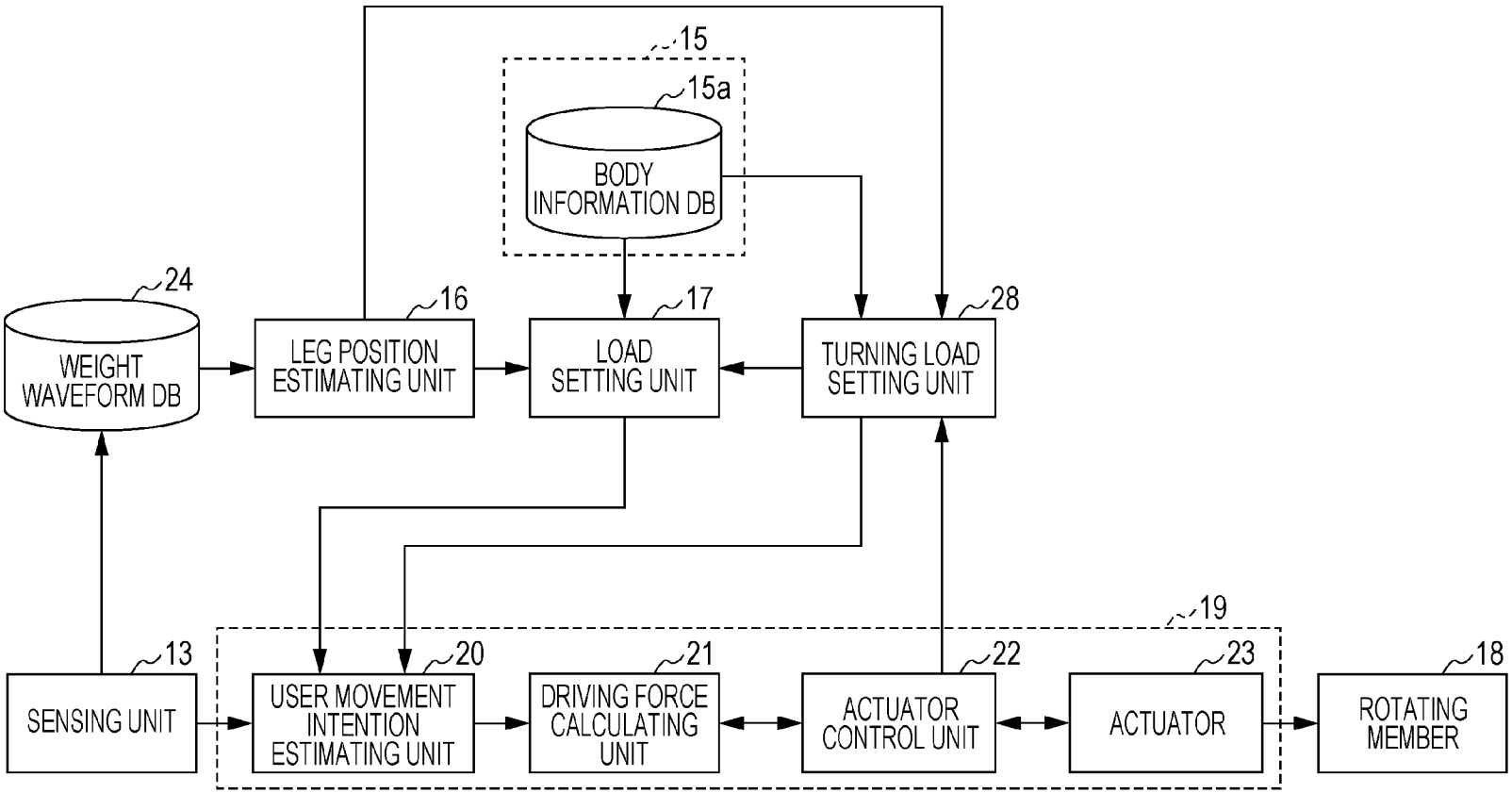
FIG. 24 is a control block diagram illustrating an example of a control configuration for walking support of the walking support robot according to Embodiment 4 of the present disclosure.

FIG. 23 is a control block diagram illustrating an example of a main control configuration of a walking support robot 71 (hereinafter referred to as a "robot 71") according to Embodiment 4. FIG. 24 is a control block diagram illustrating an example of a control configuration for walking support of the robot 71.

As illustrated in FIGS. 23 and 24, in Embodiment 4, the robot 71 includes a turning load setting unit 28.

The turning load setting unit 28 sets a turning load. Specifically, the turning load setting unit 28 sets a radius of turn of the robot 71 on the basis of body information and information on a leg position. For example, the turning load setting unit 28 sets a radius of turn in a case where a center of gravity is on a right leg during walking smaller than a radius of turn in a case where a center of gravity is on a left leg during walking in a case where it is determined that a muscular strength of the right leg is weaker than a muscular strength of the left leg on the basis of body information. When a radius of turn of the robot 71 becomes smaller, the robot 71 sharply turns. As a result, a load on a user during the turn is increased. In Embodiment 4, setting of a load varies depending on a user.

Setting of Turning Load

Figure 25:
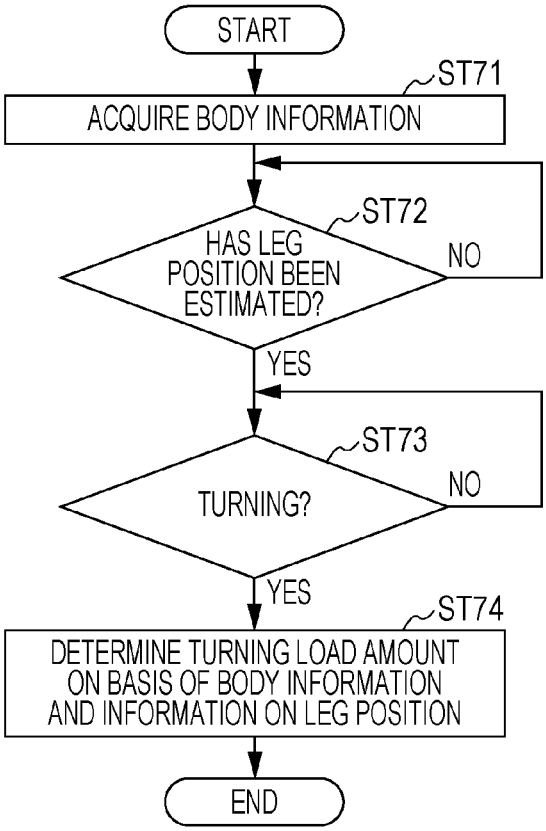
FIG. 25 is an exemplary flowchart of a turning load setting process of the walking support robot according to Embodiment 4 of the present disclosure.

Setting of a turning load is described with reference to FIG. 25. FIG. 25 is an exemplary flowchart of a turning load setting process of the robot 71.

As illustrated in FIG. 25, in Step ST71, the turning load setting unit 28 acquires body information from a body information acquisition unit 15.

In Step ST72, the turning load setting unit 28 determines whether or not a leg position estimating unit 16 has estimated a leg position. In a case where the leg position estimating unit 16 has estimated a leg position, Step ST73 is performed. In a case where the leg position estimating unit 16 has not estimated a leg position, Step ST72 is repeated.

In Step ST73, the turning load setting unit 28 determines whether or not the robot 71 is turning. Specifically, the turning load setting unit 28 acquires information on amounts of rotation of rotating members 18 from an actuator control unit 22 and determines whether or not the robot 71 is turning on the basis of the information on the amounts of rotation. For example, the turning load setting unit 28 determines that the robot 71 is turning in a clockwise direction in a case where an amount of rotation of the left rotating member 18 is smaller than an amount of rotation of the right rotating member 18. Meanwhile, the turning load setting unit 28 determines that the robot 71 is not turning in a case where the amount of rotation of the left rotating member 18 is equal to the amount of rotation of the right rotating member 18.

In a case where it is determined in Step ST73 that the robot 71 is turning, Step ST74 is performed. In a case where it is determined that the robot 71 is not turning, Step ST73 is repeated.

In Step ST74, the turning load setting unit 28 sets an amount of turning load on the basis of the body information acquired in Step ST71 and information on the leg position estimated in Step ST72.

FIG. 26 illustrates an example of turning load setting. As illustrated in FIG. 26, the turning load setting unit 28 sets a radius of turn for each leg position while focusing on a tibialis anterior muscle of a leg portion as body information. In the example illustrated in FIG. 26, the turning load setting unit 28 determines that a tibialis anterior muscle of a right leg is weaker than a tibialis anterior muscle of a left leg. In this case, the turning load setting unit 28 sets a turning load so that a radius of turn in a case where a center of gravity is on the right leg during walking becomes smaller than a radius of turn in a case where a center of gravity is on the left leg during walking.

Effects

According to the walking support robot 71 according to Embodiment 4, it is possible to produce the following effects.

According to the robot 71, it is possible to efficiently improve physical performance by changing a radius of turn during turning of the robot 71.

Although a radius of turn has been described as a turning load in Embodiment 4, Embodiment 4 is not limited to this. For example, the turning load may be a turning speed, a handle weight, or the like.

Although an example in which setting of an amount of turning load varies depending on a user has been described in Embodiment 4, Embodiment 4 is not limited to this. For example, an amount of turning load may be a uniform value common to all users.

Although an example in which a muscle of a leg portion is used as body information has been described in Embodiment 4, Embodiment 4 is not limited to this. The body information may be, for example, a walking speed, a walking rate, a body tilt, a body shake, a stride, or a muscular strength.

Although an example in which the turning load setting unit 28 sets a turning load on the basis of body information has been described in Embodiment 4, Embodiment 4 is not limited to this. For example, the turning load setting unit 28 may set a turning load in accordance with a user's movement intention, a muscle to which a load is to be applied, a current moving speed, or whether a state of acceleration is acceleration, constant speed, or deceleration.

Although an example in which the turning load setting unit 28 acquires information on amounts of rotation of the rotating members 18 from the actuator control unit 22 and determines whether or not the robot 71 is turning on the basis of the information on the amounts of rotation in Step ST73 has been described in Embodiment 4, Embodiment 4 is not limited to this. For example, the turning load setting unit 28 may acquire information on a user's moving direction from a user movement intention estimating unit 20 and determine whether or not the robot 71 is turning on the basis of the information on the user's moving direction. Alternatively, the turning load setting unit 28 may acquire information on driving force from a driving force calculating unit 21 and determine whether or not the robot 71 is turning on the basis of the information on the driving force.

Embodiment 5

A walking support robot according to Embodiment 5 of the present disclosure is described below. In Embodiment 5, differences from Embodiment 1 are mainly described. In Embodiment 5, constituent elements that are identical or similar to those in Embodiment 1 are given identical reference signs. Furthermore, in Embodiment 5, descriptions similar to those in Embodiment 1 are omitted.

Embodiment 5 is different from Embodiment 1 in that a guide information generating unit that generates guide information for guiding a user is provided and a load is set on the basis of the guide information.

Control Configuration of Walking Support Robot

Figure 27:
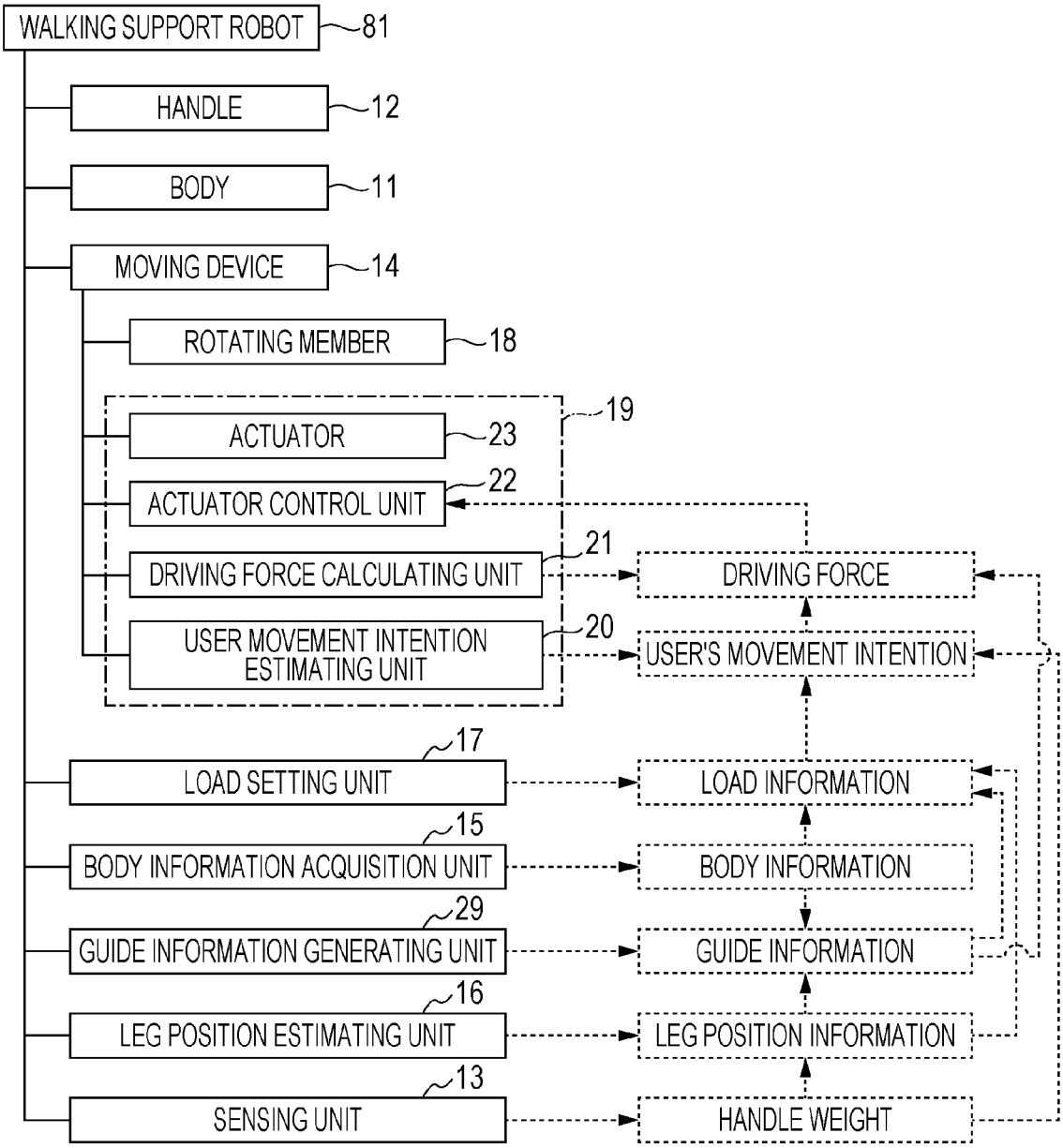
FIG. 27 is a control block diagram illustrating an example of a main control configuration of a walking support robot according to Embodiment 5 of the present disclosure.
Figure 28:
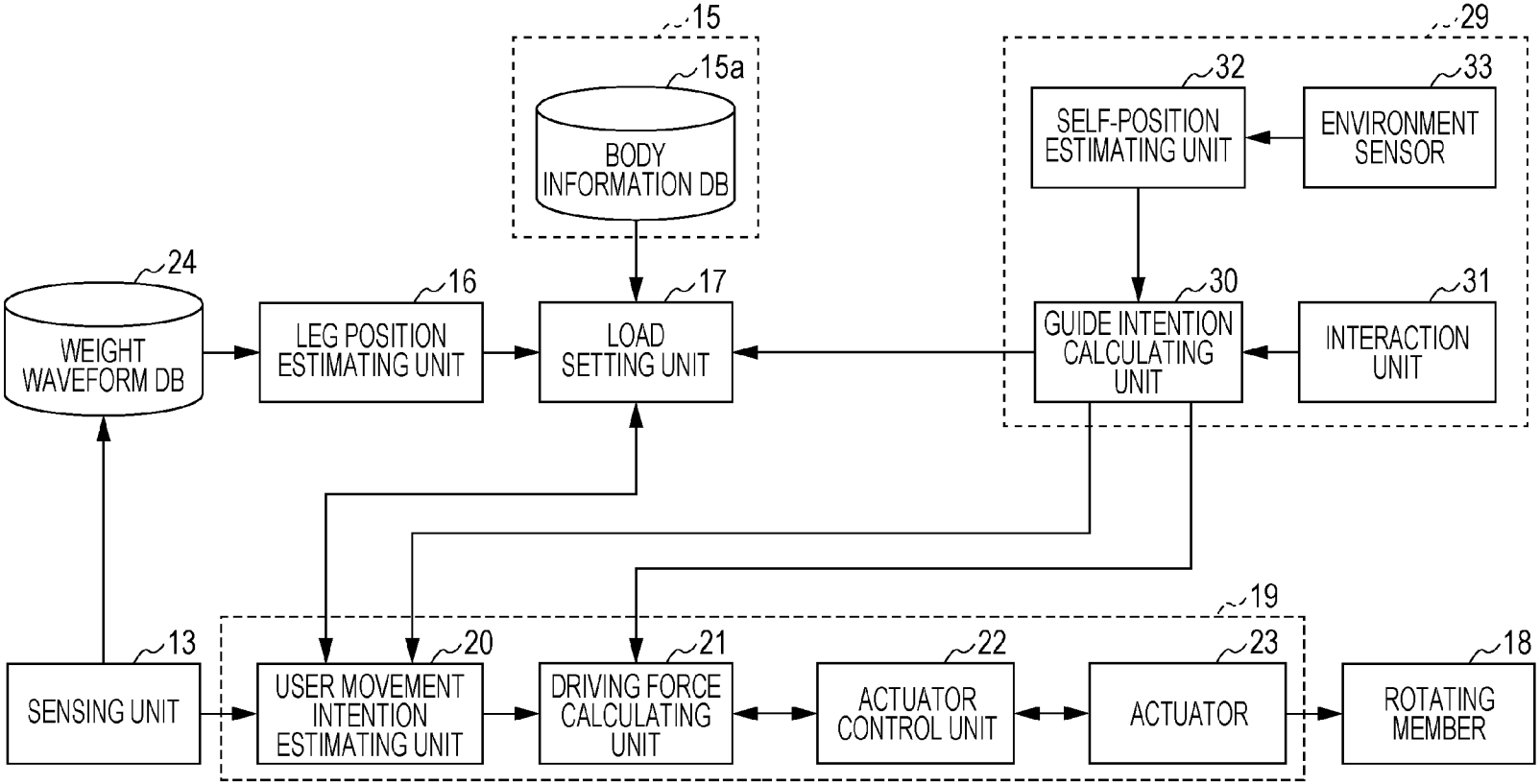
FIG. 28 is a control block diagram illustrating an example of a control configuration for walking support of the walking support robot according to Embodiment 5 of the present disclosure.

FIG. 27 is a control block diagram illustrating an example of a main control configuration of a walking support robot 81 (hereinafter referred to as a "robot 81") according to Embodiment 5. FIG. 28 is a control block diagram illustrating an example of a control configuration for walking support of the robot 81.

As illustrated in FIGS. 27 and 28, in Embodiment 5, the robot 81 includes a guide information generating unit 29. The robot 81 autonomously moves on the basis of guide information generated by the guide information generating unit 29 and thus guides a user to a destination.

The guide information as used herein is information used by the robot 81 to guide a user to a destination and includes, for example, information such as a guide speed, a guide direction, and a guide distance.

The guide information generating unit 29 generates guide information for guiding a user to a destination. The guide information generating unit 29 includes a guide information calculating unit 30, an interaction unit 31, a self-position estimating unit 32, and an environment sensor 33. In Embodiment 5, the interaction unit 31 and the environment sensor 33 are not essential.

The guide information calculating unit 30 calculates a guide intention for guiding a user to a destination. The guide information calculating unit 30 calculates a guide intention on the basis of destination information, self-position information of the robot 81, and map information. The guide information calculated by the guide information calculating unit 30 is transmitted to a driving force calculating unit 21.

The destination information includes, for example, a destination, an arrival time, a walking route, and a purpose (e.g., meal, sleep). The destination information is acquired, for example, by user's input using the interaction unit 31. The self-position of the robot 81 is estimated by the self-position estimating unit 32. The map information is stored, for example, in a storage unit (not illustrated) of the robot 81. For example, the map information may be stored in advance in the storage unit or may be created by using the environment sensor 33. The map information can be created by using a SLAM technology.

The interaction unit 31 is a device by which a user inputs destination information such as a destination and is constituted, for example, by a voice-input device or a touch panel. The destination information input by using the interaction unit 31 is transmitted to the guide information calculating unit 30.

The self-position estimating unit 32 estimates a self-position of the robot 81. The self-position estimating unit 32 estimates a self-position of the robot 81, for example, on the basis of information acquired by the environment sensor 33. Information on the self-position estimated by the self-position estimating unit 32 is transmitted to the guide information calculating unit 30.

The environment sensor 33 is a sensor that senses information on an environment surrounding the robot 81. The environment sensor 33 can be constituted, for example, by a distance sensor, a laser range finder (LRF), a laser imaging detection and ranging (LIDAR), a camera, a depth camera, a stereo camera, a sonar, a sensor such as a RADAR, a global positioning system (GPS), or a combination thereof. Information acquired by the environment sensor 33 is transmitted to the self-position estimating unit 32.

In Embodiment 5, the driving force calculating unit 21 calculates driving force for autonomously driving the robot 81 on the basis of guide information acquired from the guide information calculating unit 30. Next, an actuator control unit 22 controls driving of an actuator 23 on the basis of information on the driving force calculated by the driving force calculating unit 21. The actuator 23 drives a rotating member 18, and thus the robot 81 autonomously moves. By autonomous movement of the robot 81, a user is guided to a destination.

A load setting unit 17 sets a load applied to a user on the basis of body information, information on a leg position, and guide information. For example, the load setting unit 17 sets a load so that a guide distance is prolonged while a position of a right leg is initial contact or loading response in a case where it is determined that a soleus muscle of the right leg is weaker than a soleus muscle of a left leg.

Furthermore, the load setting unit 17 determines whether or not the robot 81 is guiding and sets a load in a case where the robot 81 is guiding. Specifically, the load setting unit 17 determines whether or not a user is walking in accordance with guide of the robot 81 and sets a load in a case where the user is moving in accordance with guide of the robot 81.

Setting of Load

Figure 29:
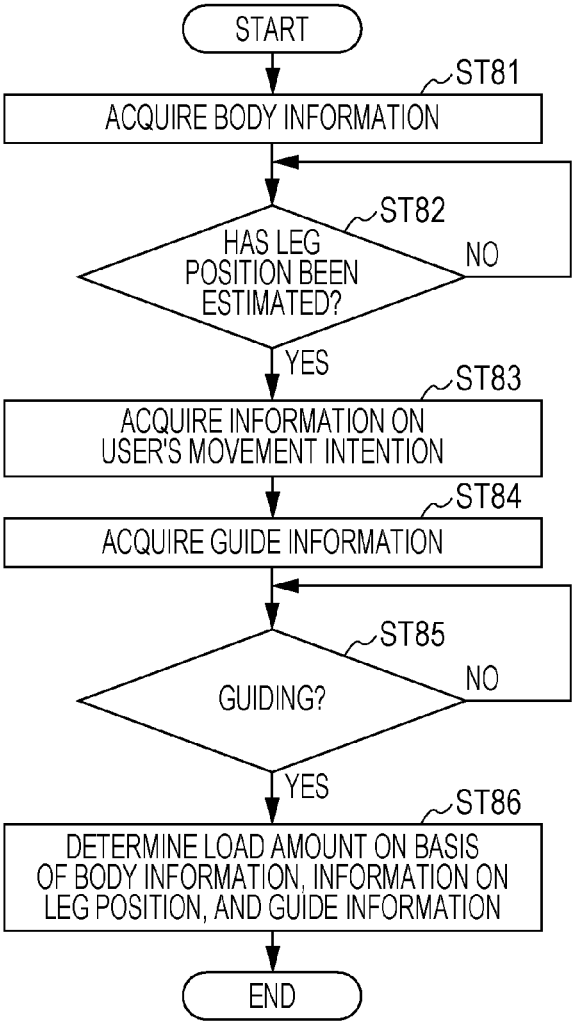
FIG. 29 is an exemplary flowchart of a load setting process based on guide information of the walking support robot according to Embodiment 5 of the present disclosure.

Setting of a load is described with reference to FIG. 29. FIG. 29 is an exemplary flowchart of a load setting process of the robot 81.

As illustrated in FIG. 29, in Step ST81, the load setting unit 17 acquires body information from the body information acquisition unit 15.

In Step ST82, the load setting unit 17 determines whether or not a leg position has been estimated by a leg position estimating unit 16. In a case where a leg position has been estimated by the leg position estimating unit 16, Step ST83 is performed. In a case where a leg position has not been estimated by the leg position estimating unit 16, Step ST82 is repeated.

In Step ST83, the load setting unit 17 acquires information on a user's movement intention from a user movement intention estimating unit 20.

In Step ST84, the load setting unit 17 acquires guide information from the guide information calculating unit 30.

In Step ST85, the load setting unit 17 determines whether or not the robot 81 is guiding. Specifically, the load setting unit 17 determines whether or not the user is walking in accordance with guide of the robot 81 on the basis of the user's movement intention (a moving direction and a moving speed) acquired in Step ST83 and the guide information (a guide direction and a guide speed) acquired in Step ST84.

In a case where the load setting unit 17 determines that the robot 81 is guiding, Step ST86 is performed. Meanwhile, in a case where the load setting unit 17 determines that the robot 81 is not guiding, Step ST85 is repeated.

In Step ST86, the load setting unit 17 sets a load on the basis of the body information acquired in Step ST81, the information on the leg position acquired in Step ST82, and the guide information acquired in Step ST84.

FIG. 30 illustrates an example of load setting. As illustrated in FIG. 30, the load setting unit 17 sets a guide distance for each leg position while focusing on a tibialis anterior muscle of a leg portion as body information. In the example illustrated in FIG. 30, the load setting unit 17 determines that a tibialis anterior muscle of a right leg is weaker than a tibialis anterior muscle of a left leg. In this case, the load setting unit 17 sets a load so that a guide distance in a case where a center or gravity is on the right leg becomes longer than a guide distance in a case where a center or gravity is on the left leg during walking.

Effects

According to the walking support robot 81 according to Embodiment 5, it is possible to produce the following effects.

According to the robot 81, it is possible to apply a load to a user by changing a guide distance while guiding the user. It is therefore possible to efficiently improve physical performance while guiding the user.

Although a guide distance has been described as a load in Embodiment 5, Embodiment 5 is not limited to this. For example, the load may be a guide speed, a handle weight, or the like.

Although an example in which a load amount is set for each user has been described in Embodiment 5, Embodiment 5 is not limited to this. For example, a load amount may be a uniform value common to all users.

Although a muscle of a leg portion is used as an example of body information in Embodiment 5, Embodiment 5 is not limited to this. The body information may be, for example, a walking speed, a walking rate, a body tilt, a body shake, a stride, or a muscular strength.

Although an example in which the load setting unit 17 sets a load on the basis of body information has been described in Embodiment 5, Embodiment 5 is not limited to this. For example, the load setting unit 17 may set a load in accordance with a user's movement intention, a muscle to which a load is to be applied, a current moving speed, or whether a state of acceleration is acceleration, constant speed, or deceleration.

The load setting unit 17 may set a load during guide on the basis of information on a leg position and guide information without body information.

Although an example in which the robot 81 autonomously moves so as to guide a user to a destination has been described in Embodiment 5, Embodiment 5 is not limited to this. For example, the robot 81 may guide a user along a loop-shaped path, such as a ring-shaped loop or a figure-of-eight loop, i.e., a route having no destination. The route having no destination may be a route that turns at any angle when the route comes close to a wall, an obstacle, or the like within a predetermined area. Alternatively, the route having no destination may be a route for which only the number and kinds of curves, the number of straight lines, and the like are preset and a walking direction is determined by a user.

The present disclosure has been described in each embodiment in some degree of detail, but the disclosure in these embodiments may be changed in a detail of a configuration. Furthermore, a combination of elements and a change of order in each embodiment can be realized without departing from the scope and idea of the present disclosure.

The present disclosure is applicable to a walking support robot and a walking support method that can improve physical performance while supporting user's walking.

What is claimed is:

1. A walking support robot, comprising:

a body;

a handle that is on the body and configured to be held by a user;

a sensor that senses a force applied to the handle;

a moving device that includes a rotating member and moves the walking support robot by controlling rotation of the rotating member in accordance with the force sensed by the sensor; and a processor that, in operation, performs operations including:

acquiring body information of the user;

estimating a leg position of the user on a basis of a change of the force sensed by the sensor;

determining a muscle to which a load is to be applied to the user on a basis of the body information and a basis of the leg position; and setting the load to be applied to the user, in accordance with the determined muscle, on the basis of the body information and the basis of the leg position.

2. The walking support robot according to claim 1, wherein the operations further include correcting the force on the basis of the leg position.

3. The walking support robot according to claim 1, wherein the operations further include notifying the user of at least one of the body information, information on the leg position, and information on the load.

4. The walking support robot according to claim 1, wherein in the acquiring the body information, the body information is estimated on a basis of the force sensed by the sensor.

5. The walking support robot according to claim 1, wherein the operations further include changing a radius of turn of the walking support robot on the basis of the body information and the basis of the leg position.

6. The walking support robot according to claim 1, wherein the operations further include:

generating guide information for guiding the user; and causing the moving device to move the walking support robot on a basis of the guide information, and in the setting the load, the load is set on the basis of the body information, the basis of the leg position, and the basis of the guide information.

7. The walking support robot according to claim 6, wherein in the setting the load, the load is set by changing a guide distance over which the user is guided by the walking support robot in accordance with the basis of the leg position.

8. The walking support robot according to claim 1, wherein the body information includes strides; and in the setting the load, the load is set on a basis of a difference between a stride of a left leg and a stride of a right leg.

9. The walking support robot according to claim 1, wherein in the setting the load, the load is set for each of a plurality of leg positions.

10. The walking support robot according to claim 1, wherein in the setting the load, the load is set further on the basis of the change of the force.

11. A walking support method for supporting walking of a user by using a walking support robot, the walking support method comprising:

causing a sensor to sense a force applied to a handle of the walking support robot;

causing a moving device of the walking support robot to move the walking support robot in accordance with the force sensed by the sensor;

acquiring body information of the user;

estimating a leg position of the user on a basis of a change of the force;

determining a muscle to which a load is to be applied to the user on a basis of the body information and a basis of the leg position; and setting a load to be applied to the user, in accordance with the determined muscle, on the basis of the body information and the basis of the leg position.

12. The walking support method according to claim 11, wherein in the setting the load, the force is corrected on the basis of the leg position.

13. The walking support method according to claim 11, further comprising:

notifying the user of at least one of the body information, information on the leg position, and information on the load.

14. The walking support method according to claim 11, wherein in the acquiring the body information, the body information is estimated on a basis of the force.

15. The walking support method according to claim 11, further comprising:

changing a radius of turn of the walking support robot on the basis of the body information and the basis of the leg position.

16. The walking support method according to claim 11, further comprising:

generating guide information for guiding the user; and causing the moving device to move the walking support robot on a basis of the guide information, wherein, in the setting the load, the load is set on the basis of the body information, the basis of the leg position, and the basis of the guide information.

* * * * *